US008776811B2

(12) United States Patent
Griffith

(10) Patent No.: US 8,776,811 B2
(45) Date of Patent: Jul. 15, 2014

(54) VEHICLE ANCHORED ACCESSORY HOLDER AND ASSOCIATED METHODS

(76) Inventor: Edward Griffith, Titusville, FL (US)

( * ) Notice: Subject to any disclaimer, the term of this patent is extended or adjusted under 35 U.S.C. 154(b) by 609 days.

(21) Appl. No.: 13/006,046

(22) Filed: Jan. 13, 2011

(65) Prior Publication Data

US 2011/0168219 A1 Jul. 14, 2011

Related U.S. Application Data

(60) Provisional application No. 61/294,614, filed on Jan. 13, 2010.

(51) Int. Cl.
*E04G 15/06* (2006.01)

(52) U.S. Cl.
USPC ..... 135/88.06; 135/88.05; 135/114; 248/125.7; 248/159; 248/503

(58) Field of Classification Search
CPC ..... E04H 6/04; B60J 11/00
USPC ..... 248/676, 678, 125.7, 159, 163.1, 440, 248/188, 188.1, 188.7, 188.8, 161, 411, 248/413, 157, 500, 503, 499, 510; 135/88.05, 88.06, 114
See application file for complete search history.

(56) References Cited

U.S. PATENT DOCUMENTS 2,042,443 A * 5/1936 Buckstone ..... 248/411
3,014,682 A * 12/1961 Veneman ..... 248/161
3,765,434 A * 10/1973 Riggs ..... 135/20.1
4,655,236 A * 4/1987 Dorame et al. ..... 135/88.06
4,744,690 A * 5/1988 Hsieh ..... 403/104
5,158,103 A * 10/1992 Leu ..... 135/88.06
5,241,977 A * 9/1993 Flores et al. ..... 135/88.06
5,450,703 A * 9/1995 Fuhrman et al. ..... 52/843
5,850,843 A * 12/1998 Mahood et al. ..... 135/88.06
5,911,399 A * 6/1999 Mannion ..... 248/514
6,035,874 A * 3/2000 Po-Chang ..... 135/88.06
6,089,246 A * 7/2000 Barnes ..... 135/88.06
6,155,743 A * 12/2000 Chen ..... 403/374.1
6,412,506 B1 * 7/2002 Reese ..... 135/20.1
7,195,377 B2 * 3/2007 Tsai ..... 362/431
2002/0088907 A1 * 7/2002 Phillips ..... 248/157
2003/0052240 A1 * 3/2003 Springett ..... 248/163.1
2006/0254635 A1 * 11/2006 Matheus et al. ..... 135/88.05
2007/0145202 A1 * 6/2007 Hsieh ..... 248/161

* cited by examiner

*Primary Examiner* — Terrell McKinnon
*Assistant Examiner* — Michael McDuffie
(74) *Attorney, Agent, or Firm* — Mark R. Malek; G. Phillip J. Zies; Zies Widerman & Malek

(57) ABSTRACT

A vehicle anchored accessory holder may include a base plate, a brace connected to and extending upwardly from the base plate and an angled support connected to the at least one brace. The vehicle anchored accessory holder may also include a female fitting connected to and extending upwardly from the base plate. The female fitting may also be connected to the angled support. The female fitting may have an open top to receive at least one of an extension arm stem and an accessory. A first tube and a second tube may be connected to an upper portion of the female fitting to receive a connector adapted to move the female fitting between an opened position and a closed position.

18 Claims, 35 Drawing Sheets

VEHICLE ANCHORED ACCESSORY HOLDER AND ASSOCIATED METHODS

RELATED APPLICATIONS

The present application claims the benefit of U.S. Provisional Patent Application Ser. No. 61/294,614 titled VEHICLE ANCHORED ACCESSORY HOLDER AND ASSOCIATED METHODS filed by the inventor of the present invention on Jan. 13, 2010, the entire contents of which are incorporated herein by reference.

FIELD OF THE INVENTION

The present invention relates to the field of holders for accessories and, more specifically, to the field of vehicle anchored holders for accessories and associated methods.

BACKGROUND OF THE INVENTION

It is commonly known that people use accessories in order to work, play and relax in and around their vehicles. A retailer may set up a booth to offer their wares for sale out of the back of their vehicle at a flea market, trade show, car show or other venue. Beachgoers and tailgaters may set up umbrellas or canopies for shade. A weekend camper, beachgoer or tailgater may set up a picnic or other recreational activity in the relative comfort of close proximity to their vehicle. A longer-term camper may erect a satellite dish, wind generator, fishing pole, awning or other convenience adjacent to their recreational vehicle or other conveyance.

It is also commonly known that the environment can interfere with such use of accessories around a vehicle and the area immediately around a vehicle. Sun, wind, rain, snow and other environmental factors each may negatively impact such use. Additionally, ground conditions can be unsuitable for such use. Rocky soil, hardpan soil, sandy soil, concrete, asphalt and other paved surfaces are just a few examples of less than ideal ground conditions for some of the accessories often used in conjunction with the use of vehicles. Finally, the user may not be equipped with the proper tools to erect or install the accessories the user wishes to use in the area around their vehicle.

There are a couple of accessory holders that have attempted to ease the burden associated with setting up these accessories. For example, U.S. Pat. No. 5,850,843 to Mahood, et al., discloses an umbrella holder comprising a base plate that can be positioned beneath a vehicle wheel and an umbrella mounted to the base plate. The Mahood et al. '843 patent also discloses a method for providing shelter utilizing an apparatus which includes a base plate and an umbrella mounted to the base plate. The method includes positioning a vehicle wheel on the base plate so as to support the umbrella.

U.S. Pat. No. 6,089,246 to Barnes discloses an apparatus for supporting an umbrella. The apparatus includes a base plate, a hollow cylinder connected to a lower end of the base plate and extending upwardly therefrom, and a jack for contacting the underside of a vehicle to place a downward force on the base plate. The apparatus also optionally includes a threaded endcap for the hollow cylinder, a selectively positionable hollow cylinder and a selectively positionable jack.

There exists a need to provide a holder for accessories that are to be used in conjunction with a vehicle and which holder is to be anchored by the vehicle.

SUMMARY OF THE INVENTION

With the foregoing in mind, the present invention provides a vehicle anchored accessory holder that advantageously allows for use of an accessory around a vehicle and the area immediately around a vehicle irrespective of sun, wind, rain, snow or other environmental factors. The vehicle anchored accessory holder according to the present invention also advantageously allows for use of an accessory around a vehicle and the area immediately around a vehicle regardless of ground conditions. The vehicle anchored accessory holder according to the present invention further advantageously allows for use of an accessory around a vehicle and the area immediately around a vehicle without the need for any special tools to erect or install the accessory.

These and other objects, features and advantages according to the present invention are provided by a vehicle anchored accessory holder that may comprise a base plate, which may have a brace connected to and extending upwardly from the base plate. An angled support may be connected to the brace. A female fitting may be connected to and extend upwardly from the base plate. The angled support may extend upwardly at a predetermined angle from the base plate to the upper portion of the female fitting.

The female fitting may also be connected to the angled support and may have an open top to receive, for example, an extension arm stem or an accessory to be held therein. The female fitting may have an opening in a first side thereof to receive a fitting connector that may be moveable between an engaged position and a disengaged position to secure either the extension arm stem or the accessory. A first tube and a second tube may be connected to an upper portion of the female fitting to receive a connector which may be adapted to move the female fitting between an opened position and a closed position. Each of the first and second tubes may be oriented substantially parallel to an upper surface of the base plate.

In some embodiments of the vehicle anchored accessory holder according to the present invention, the base plate may have a substantially pentagonal shape defined by a bottom end and a top end. The bottom end may have a polygonal shape and the top end may have a triangular shape. The bottom end may be connected to the top end to define a monolithic unit. The base plate may include a first ridge connected to a first edge of the base plate and a second ridge connected to a second edge of the base plate. The second ridge may be oriented substantially parallel to the first ridge. The angled support may include a first angled support connected to the base plate adjacent the first edge and a second angled support connected to the base plate adjacent the second edge.

A collar may surround the opening in the first side of the at least one female fitting. The collar may have a threaded inner surface and the fitting connector may have a threaded exterior surface. The fitting connector may threadably engage the collar. The second tube may be aligned with the first tube so that a threaded connector may pass through the first tube and threadably engage the second tube to move the female fitting between the opened position and the closed position. The first tube may have a threaded inner surface and the second tube may have a threaded inner surface. The second tube may be aligned with the first tube so that a threaded connector may pass through and threadably engage the first tube and the second tube to move the female fitting between the opened position and the closed position.

The open top of the female fitting may have a tab attached to an upper surface portion thereof. The extension arm stem may have a flange substantially encircling the extension arm stem adjacent a medial portion thereof. The flange may have a groove formed therein to accept the tab. The extension arm stem may have an extension arm connected thereto that may extend from the extension arm stem at a predetermined angle and connect at a distal end thereof to an extension arm female fitting. The extension arm female fitting may be connected to the extension arm. The extension arm female fitting may have an open top to receive, for example, a second extension arm stem or the accessory to be held therein. The extension arm female fitting may have an opening in a first side thereof to receive an extension fitting connector that may be moveable between an engaged position and a disengaged position to secure either the second extension arm stem or the accessory. The open top of the extension arm female fitting may have a tab attached to an upper surface portion thereof. The tab may be adapted to engage a groove formed on a flange substantially encircling the second extension arm stem adjacent a medial portion thereof.

The vehicle anchored accessory holder according to the present invention may further comprise a storage bracket including a storage bracket base, and an extension arm cradle attached to and extending outwardly from the storage bracket base. The extension arm cradle may be adapted to surround a portion of the extension arm. A connector passageway may be provided adjacent a medial portion of the storage bracket base. A shaft collar may surround the connector passageway and may be positioned adjacent the extension arm cradle. The shaft collar may extend outwardly from the storage bracket base.

The base plate may include a connector receiving passageway adjacent a medial portion thereof. The connector receiving passageway may have a threaded inner surface. A storage connector may also be provided and may have a threaded exterior surface. The storage connector may be passed through the connector passageway to threadably engage the threaded inner surface of the connector receiving passageway.

The vehicle anchored accessory holder according to the present invention may further comprise an adapter including an adapter female fitting having an open top to receive the accessory to be held therein. The width of the open top may be greater than the width of the female fitting. The adapter may include an adapter extension arm stem extending downwardly from the adapter female fitting to removeably engage either the female fitting or the extension arm female fitting. The adapter female fitting may have an opening in a first side thereof to receive an adapter fitting connector that is moveable between an engaged position and a disengaged position to secure the accessory.

The vehicle anchored accessory holder according to the present invention may still further comprise an accessory shaft clamp including a cross member, a contact member, the contact member connected to and extending outwardly from a first edge of the cross member, a guide member connected to and extending outwardly from a second edge of the cross member, and a guide hole formed through a medial portion of the guide member. The contact member may be adapted to fit against, for example, either an outer surface of the extension arm stem or an outer surface of a portion of the accessory. This advantageously enhances stability of the vehicle anchored accessory holder by providing a secure fit to the extension arm stem or the accessory when held in the female fitting or the extension arm female fitting. The guide member may be adapted to permit passage of an accessory connector therethrough. The accessory connector may have a threaded exterior surface and may have a handle on an upper end thereof. The guide member also advantageously enhances stability of the vehicle anchored accessory holder according to the present invention, and the handle may advantageously be used to readily move the accessory connector to an engaged position.

DETAILED DESCRIPTION OF THE PREFERRED EMBODIMENT

Figures 1, 1A:
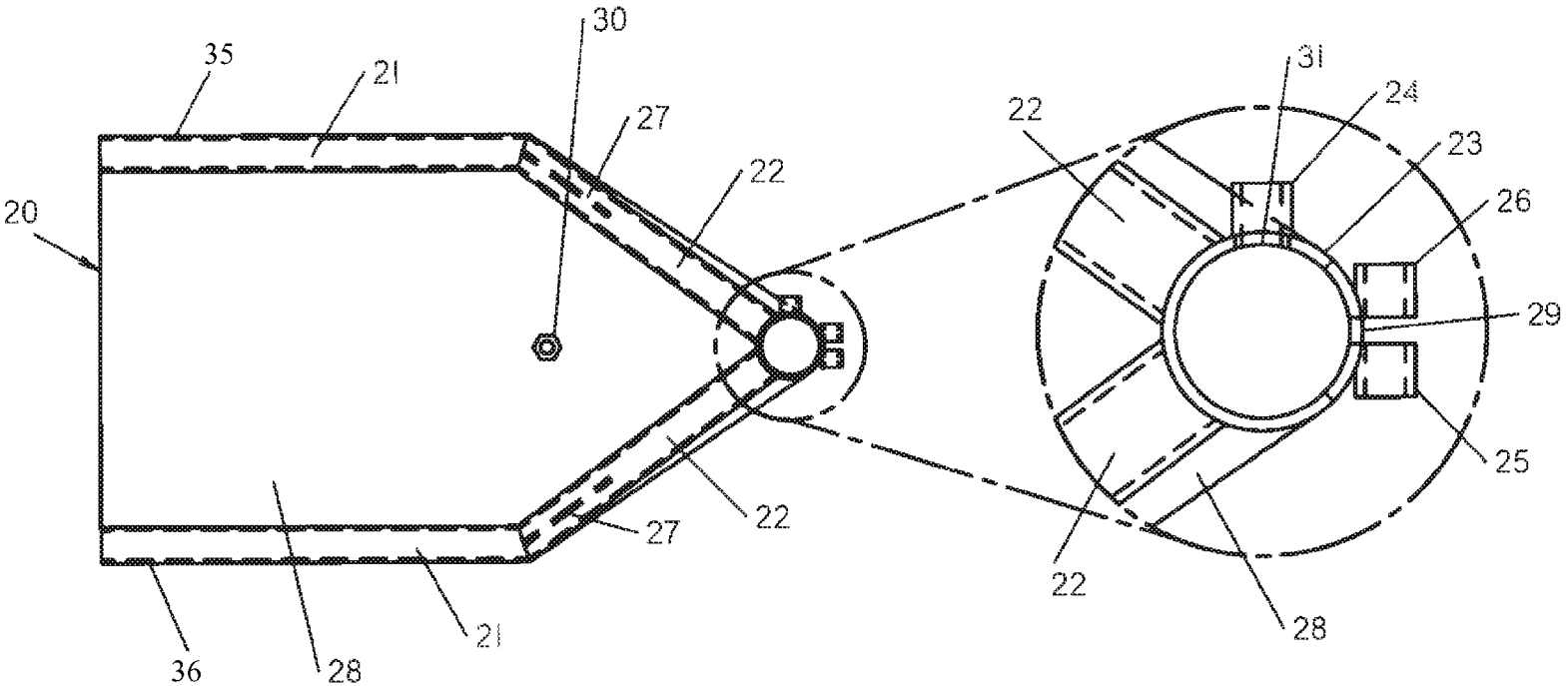
FIG. 1 is a top plan view of a base plate of a vehicle anchored accessory holder according to the present invention.
FIG. 1A is a detailed top plan view of the base plate illustrated in FIG. 1 and showing an opening for receiving an accessory to be supported.
Figure 2:
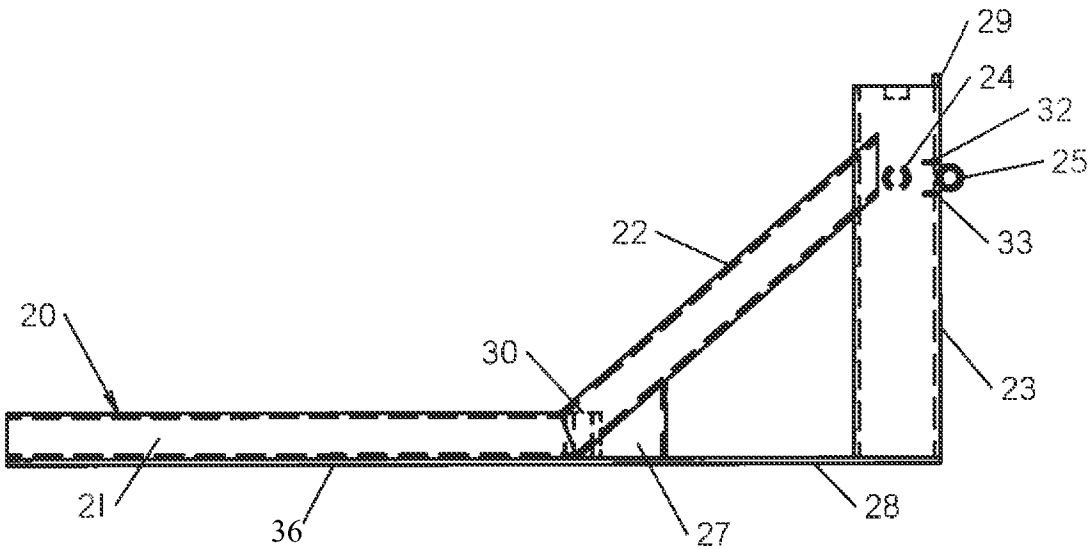
FIG. 2 is a side elevation view of the base plate illustrated in FIG. 1.
Figure 3:
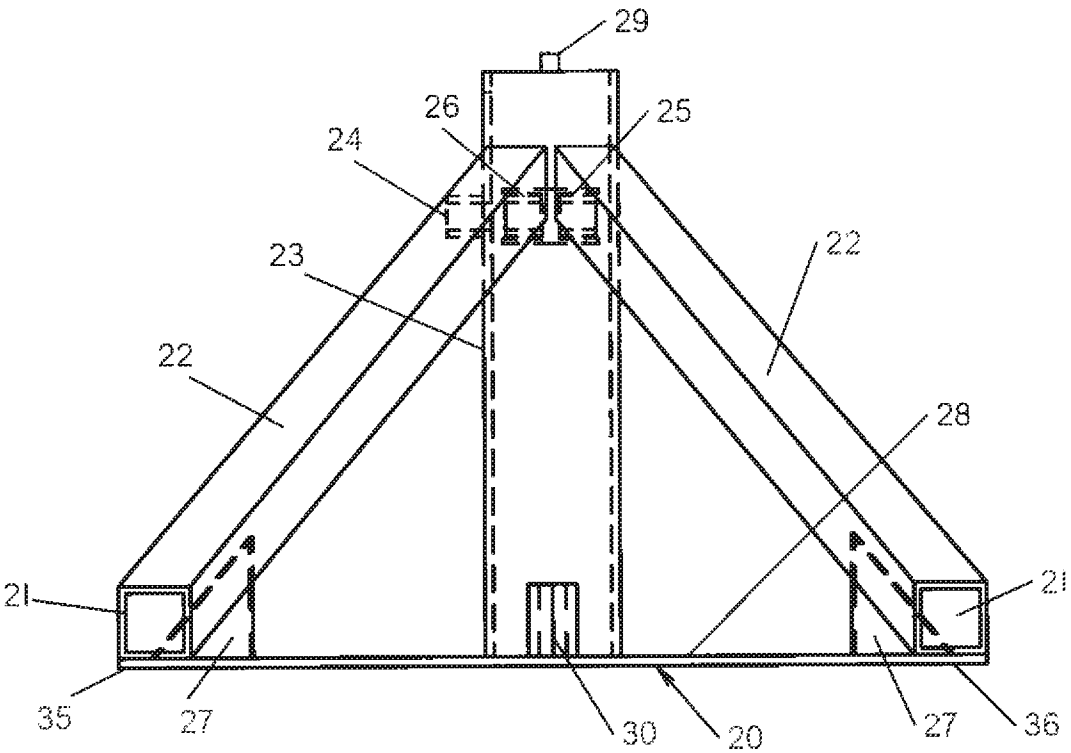
FIG. 3 is a front elevation view of the base plate illustrated in FIG. 1.

A vehicle anchored accessory holder 10 according to the present invention can advantageously provide an accessory holder extension arm 43 with a greater range of motion, resulting in increased utility and improved functionality. The present invention also advantageously provides the vehicle anchored accessory holder 10 with greatly increased portability and stowability. The vehicle anchored accessory holder 10 according to the present invention also supports a wide array of accessories.

Referring now to FIGS. 1-30, details of the vehicle anchored accessory holder 10 according to the present invention are now described in greater detail. As will be discussed in greater detail below, the unique design of the vehicle anchored accessory holder 10 includes a base plate portion 20, an extension arm portion 40, a storage bracket portion 60, an accessory shaft clamp portion 70, a storage connector portion 80 and an accessory connector portion 170.

Individual portions of the vehicle anchored accessory holder 10 according to the present invention will now be discussed in greater detail. Referring initially to FIGS. 1-4, the base plate portion 20 of the vehicle anchored accessory holder 10 according to the present invention is illustrated. The base plate portion 20 of the vehicle anchored accessory holder 10 includes a base 28 with a female fitting 23 connected thereto and extending upwardly therefrom. After having had the benefit of reading this disclosure, those skilled in the art will appreciate that the female fitting 23, while depicted in FIGS. 1-4, 14-16, and 18-30 as a round cylinder, may be a square-shaped, triangular-shaped, star-shaped, trapezoidal-shaped or any other-shaped female fitting in order to accept an appropriately shaped shaft, while still accomplishing the goals, features and objectives according to the present invention. Furthermore, those skilled in the art will appreciate that the base plate portion 20 may have multiple female fittings 23 connected to the base 28 and extending upwardly therefrom while accomplishing the goals, features, and advantages according to the present invention. A fastener 30 may be provided on the surface of the base 28. The fastener 30 may, for example, be a threaded nut, but those skilled in the art will appreciate that the fastener may be provided by any similar device while accomplishing the goals, features, and advantages according to the present invention.

The base plate portion 20 of the vehicle anchored accessory holder 10 according to the present invention may include a ridge 21 connected to the base 28 on a first edge 35 thereof. Another ridge 21 may be connected to a second edge 36 of the base 28 and may be positioned opposite the first edge 35. Those skilled in the art will appreciate that the opposing ridges 21 may help position a vehicle wheel, not shown, over the base plate portion 20. The base plate portion 20 may also include an angled support 22 connected at a lower end to the first edge 35 and connected at an upper end to the female fitting 23. Another angled support 22 may be connected at a lower end to the second edge 36 and connected at an upper end to the female fitting 23. As perhaps best illustrated in FIG. 2, the base plate portion 20 may additionally include a brace 27 connected at a lower end to the base 28 and connected at an upper end to the angled support 22.

FIG. 1A illustrates a detail of the open end of the female fitting 23 of the base plate portion 20 of the vehicle anchored accessory holder 10 according to the present invention. An opening 31 may be provided on a first side of the female fitting 23. The opening 31 may be surrounded by a collar 24. The collar 24 may include a threaded interior surface. The opening 31 and collar 24 may permit the passage of a connector for securing an accessory or an extension arm stem 41. On a second side of the female fitting 23, adjacent to the first side, a first tube 25 connected to the female fitting 23 and a second tube 26 connected to the female fitting 23 may be provided. The second tube 26 may include a threaded interior surface. The first tube 25 and the second tube 26 may be aligned so that a connector, not pictured, may be passed through the first tube 25 to engage the threads in the second tube 26.

Figures 4, 4A:
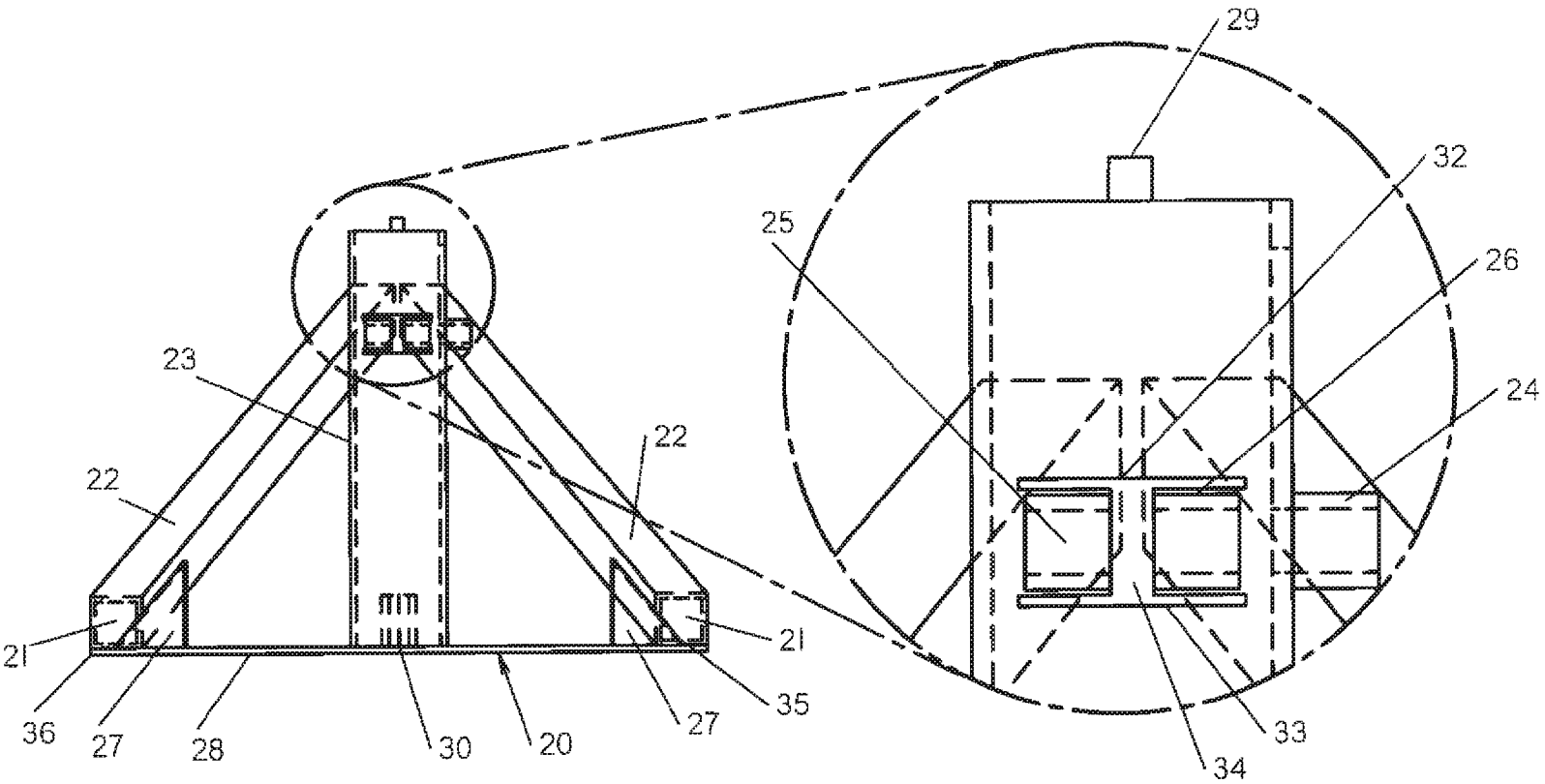
FIG. 4 is a rear elevation view of the base plate illustrated in FIG. 1.
FIG. 4A is a detail view of a portion of the base plate illustrated in FIG. 4 and showing a locking mechanism for the opening for receiving an accessory to be supported.

FIG. 4A illustrates a detail of the top of the female fitting 23 of the base plate portion 20 of the vehicle anchored accessory holder 10 according to the present invention. A first slot 32 may be provided in the female fitting 23 just above the first tube 25 and the second tube 26. A second slot 33 may be provided in the female fitting 23 just below the first tube 25 and the second tube 26 and substantially parallel to the first slot 32. A third slot 34 may be formed in the female fitting 23 between the first tube 25 and the second tube 26, and also between the first slot 32 and the second slot 33. The third slot 34 may be substantially vertically aligned. A connector may be passed through the first tube 25 to engage the threads in the second tube 26. Accordingly, as the connector is tightened within the first tube 25 and the second tube 26, the third slot 24 may be narrowed, thereby causing a tighter connection between the female fitting 23 and anything being carried by the female fitting, e.g., an accessory or an extension arm stem 41, which will be discussed in greater detail below. A tab 29 on the lip of the opening of the female fitting 23 may be provided. Additional details regarding the tab 29 will be provided below.

Figures 5, 5A:
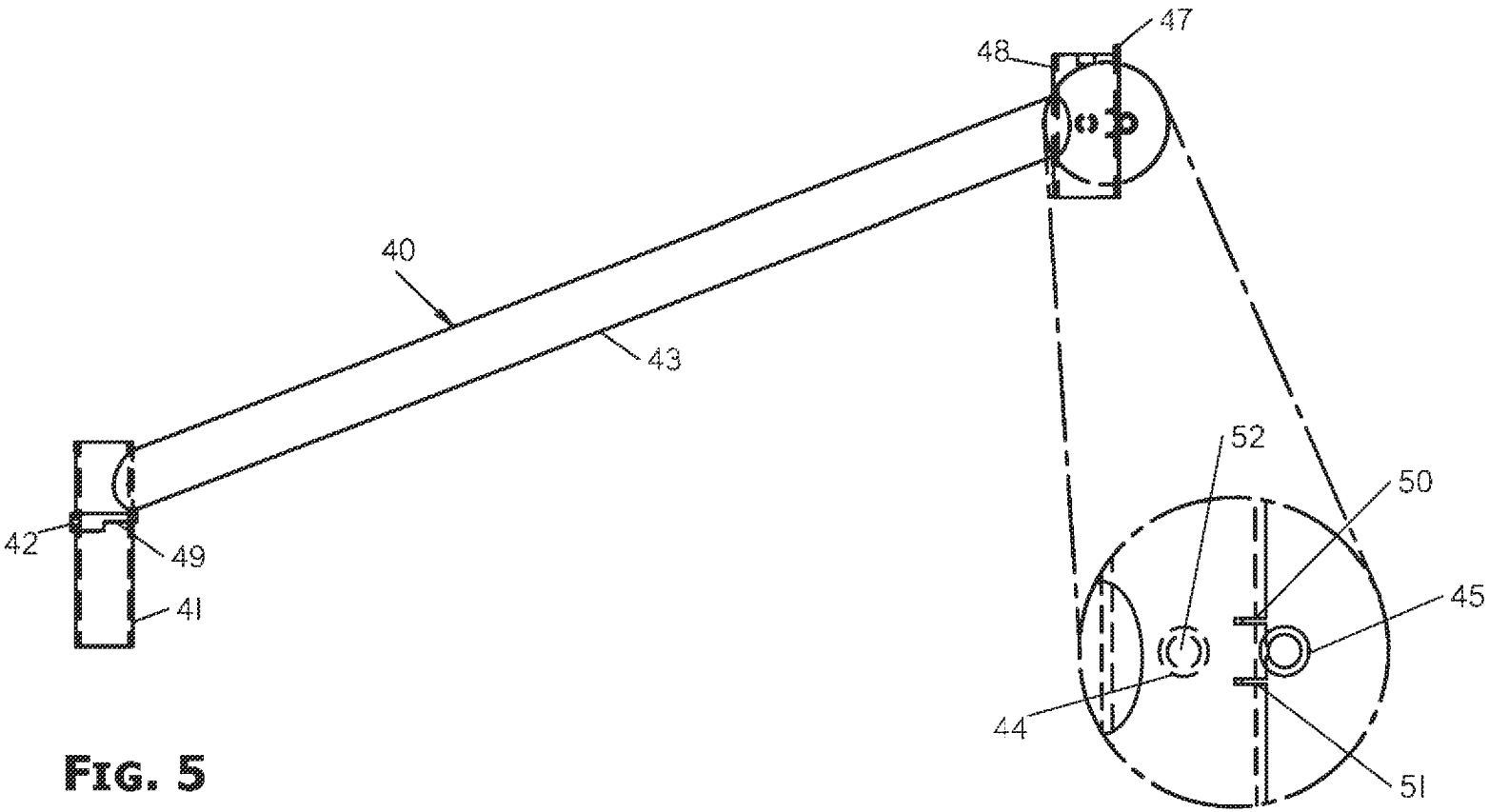
FIG. 5 is a side elevation view of an extension arm of a vehicle anchored accessory holder according to the present invention.
FIG. 5A is a detailed top plan view of a portion of a locking mechanism of the extension arm illustrated in FIG. 5

As illustrated in FIG. 5, the extension arm portion 40 may be selectively inserted into the base plate portion 20 of the vehicle anchored accessory holder 10. The extension arm portion 40 includes the extension arm stem 41, a flange 42 encircling the extension arm stem 41, an extension arm 43 connected at a first end to the extension arm stem 41 at a point above the flange 42 and connected at a second end to a female fitting 48. The extension arm stem 41 may be of an appropriate shape to be inserted into the female fitting 23 of the base plate portion 20 up to the flange 42. The flange 42 may include a groove 49 along an underside portion of its circumference consistent in depth with the height of the tab 29 of the base plate portion 20.

Figures 6, 6A:
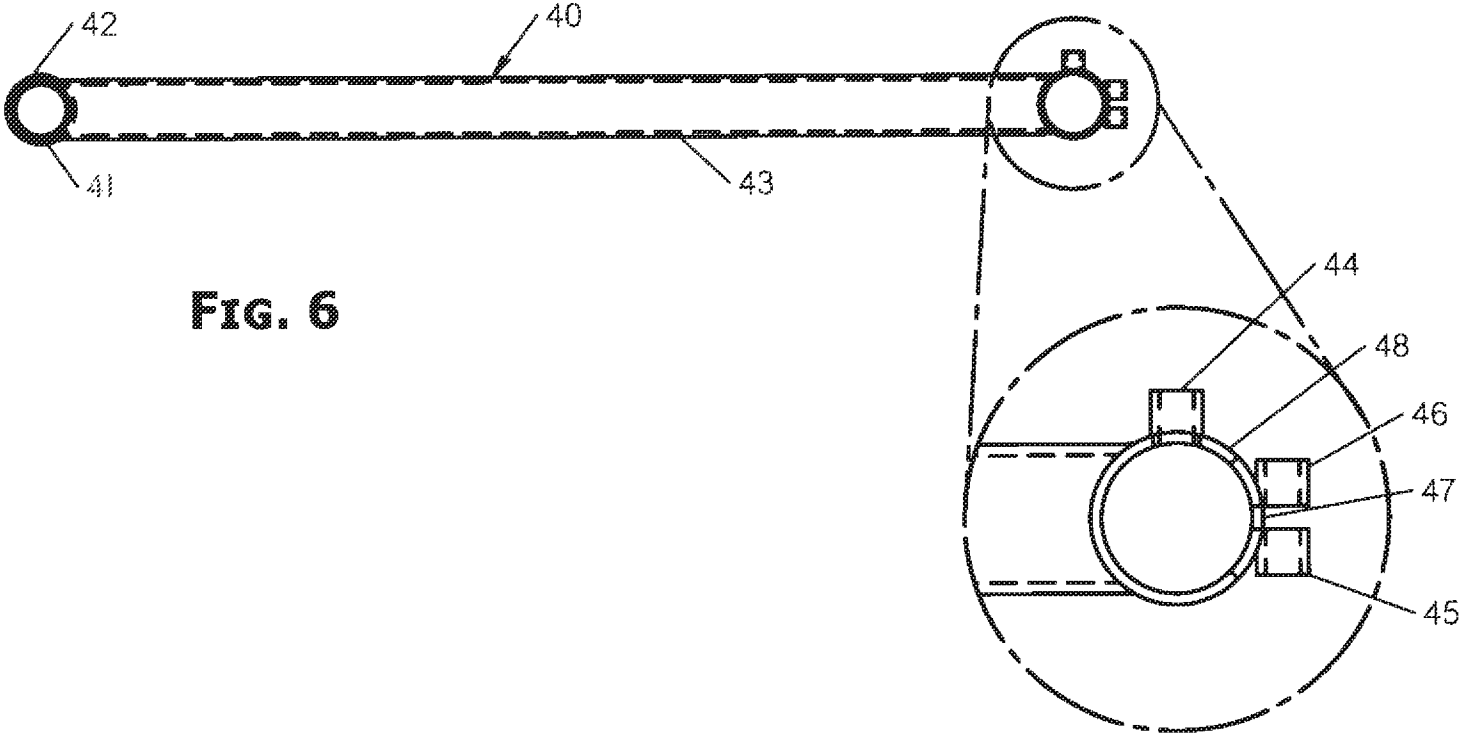
FIG. 6 is a top plan view of the extension arm illustrated in FIG. 5.
FIG. 6A is a detailed top plan view of the extension arm illustrated in FIG. 5 and showing a locking mechanism for the opening for receiving an accessory to be supported.
Figure 7:
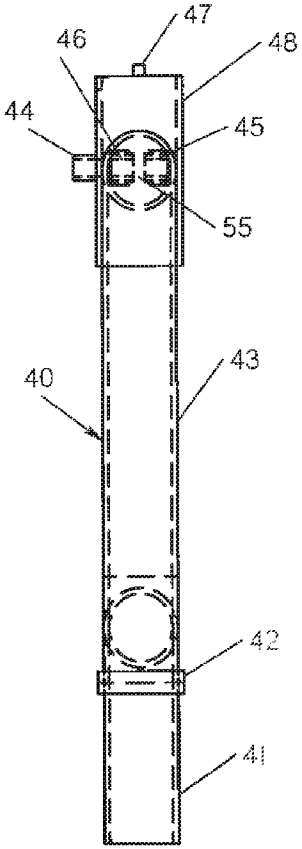
FIG. 7 is a front elevation of the extension arm illustrated in FIG. 5.

FIGS. 5A, 6 and 6A illustrate details of the female fitting 48 of the extension arm portion 40 of the vehicle anchored accessory holder 10 according to the present invention. An opening 52 may be provided on a first side of the female fitting 48. The opening 52 may be surrounded by a collar 44. The collar 44 may include a threaded interior surface. The opening 52 and collar 44 may permit the passage of a connector for securing an accessory or an extension arm stem 41. On a second side of the female fitting 48, adjacent to the first side, a first tube 45 connected to the female fitting 48 and a second tube 46 connected to the female fitting 48 may be provided. The second tube 46 may include a threaded interior surface. The first tube 45 and the second tube 46 may be aligned so that a connector, not pictured, may be passed through the first tube 45 to engage the threads in the second tube 46. A first slot 50 may be provided in the female fitting 48 just above the first tube 45 and the second tube 46. A second slot 51 may be provided in the female fitting 48 just below the first tube 45 and the second tube 46 and parallel to the first slot 50. As perhaps best illustrated in FIG. 7, a third slot 55 may be formed in the female fitting 48 between the first tube 45 and the second tube 46, and also between the first slot 50 and the second slot 51. The third slot 55 may be substantially vertically aligned. A connector may be passed through the first tube 45 to engage the threads in the second tube 46. Accordingly, as the connector is tightened within the first tube 45 and the second tube 46, the third slot 55 may be narrowed, thereby causing a tighter connection between the female fitting 48 and anything being carried by the female fitting, e.g., an accessory or an extension arm stem 41, which will be discussed in greater detail below. A tab 47 on the lip of the opening of the female fitting 48 may be provided. Additional details regarding the tab 47 will be provided below.

Figure 8:
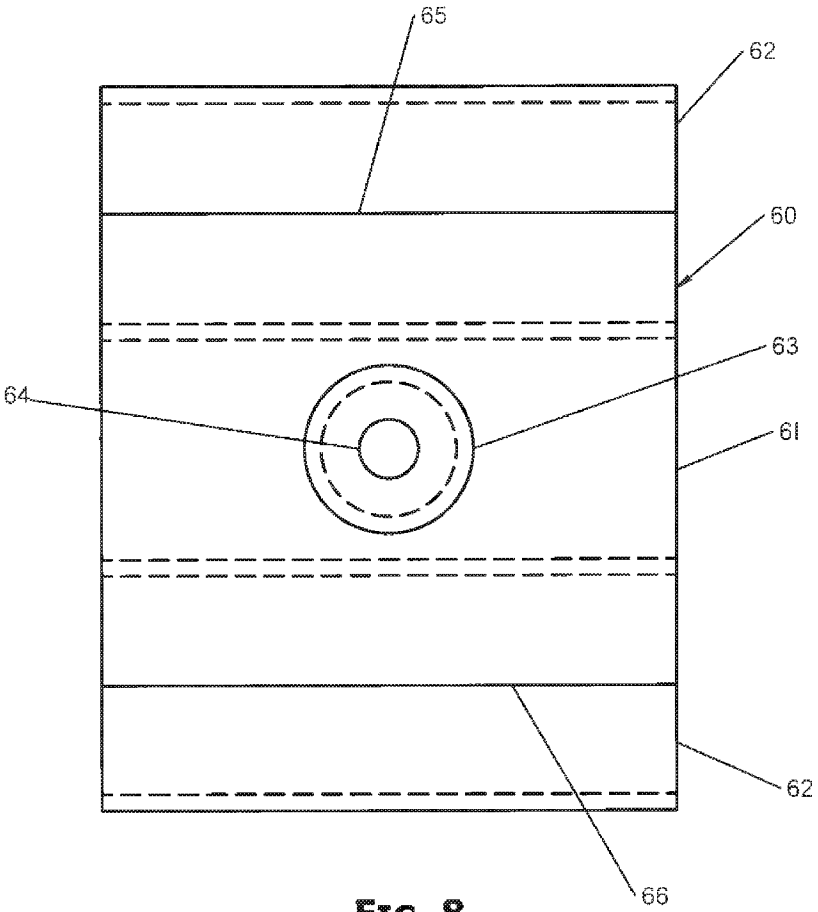
FIG. 8 is a top plan view of a storage bracket of a vehicle anchored accessory holder according to the present invention.
Figure 9:
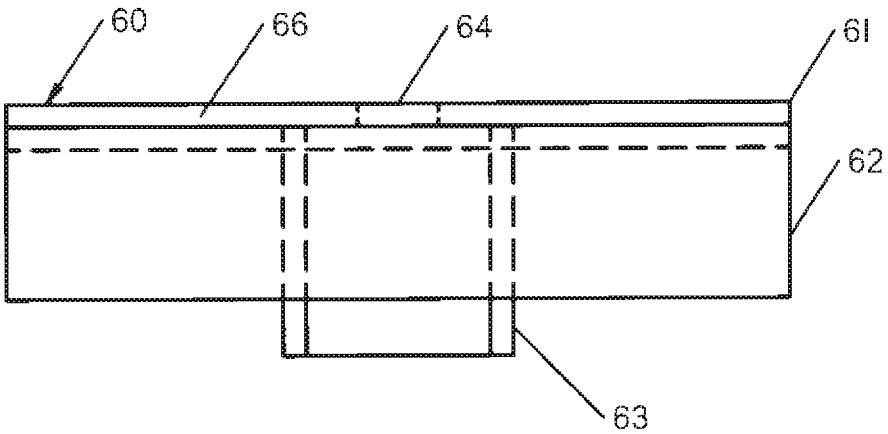
FIG. 9 is a side elevation view of the storage bracket illustrated in FIG. 8.
Figure 10:
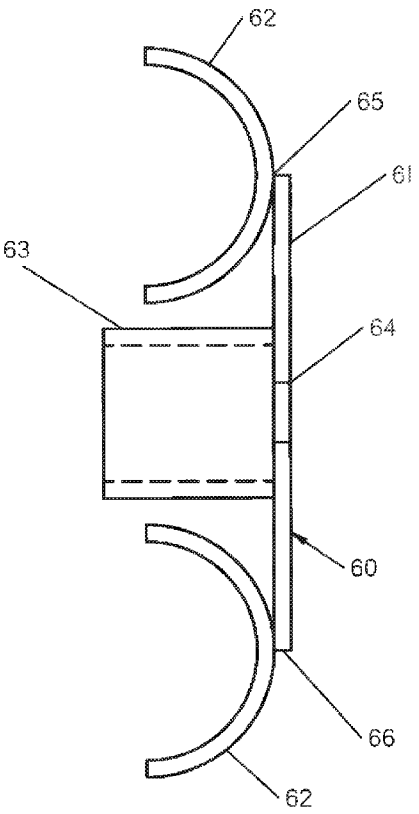
FIG. 10 is a front elevation view of the storage bracket illustrated in FIG. 8.

FIGS. 8-10 illustrate the storage bracket portion 60 of the vehicle anchored accessory holder 10 according to the present invention. The storage bracket portion 60 may include a base 61 with an extension arm cradle 62 connected to a first edge 65 of the base 61 extending downwardly therefrom. Additional details regarding the function of the extension arm cradle 62 will be provided below. A similar extension arm cradle 62 may be connected to a second edge 66 of the base 61 extending downwardly therefrom opposite the first edge 65. Both extension arm cradles 62 may be in the shape of an inverted half pipe. The extension arm cradles 62 may be connected to the base 61 along the spine of each extension arm cradle 62, as perhaps best illustrated in FIG. 10. A connector passageway 64 may be provided between the extension arm cradles 62. A shaft collar 63, connected to the base 61 and extending downwardly therefrom, may surround the connector passageway 64. After having had the benefit of reading this disclosure, those skilled in the art will appreciate that the extension arm cradles 62, while depicted in FIGS. 8-10, and 19-21 as having convex profiles, may be of a square-shaped profile, triangular-shaped profile, star-shaped profile, trapezoidal-shaped profile or any other-shaped profile in order to accept an appropriately shaped shaft, while still accomplishing the goals, features and objectives according to the present invention.

Figure 11:
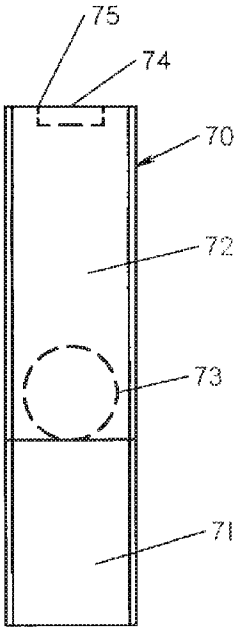
FIG. 11 is a front elevation view of an accessory shaft clamp of a vehicle anchored accessory holder according to the present invention.
Figure 12:
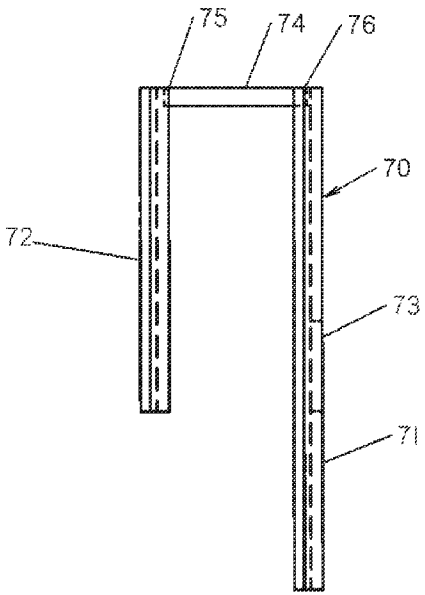
FIG. 12 is a side elevation view of the accessory shaft clamp illustrated in FIG. 11.
Figure 13:
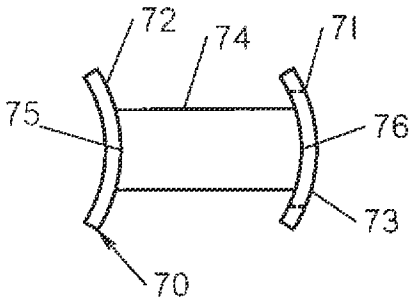
FIG. 13 is a top plan view of the accessory shaft clamp illustrated in FIG. 11.
Figures 14, 14A:
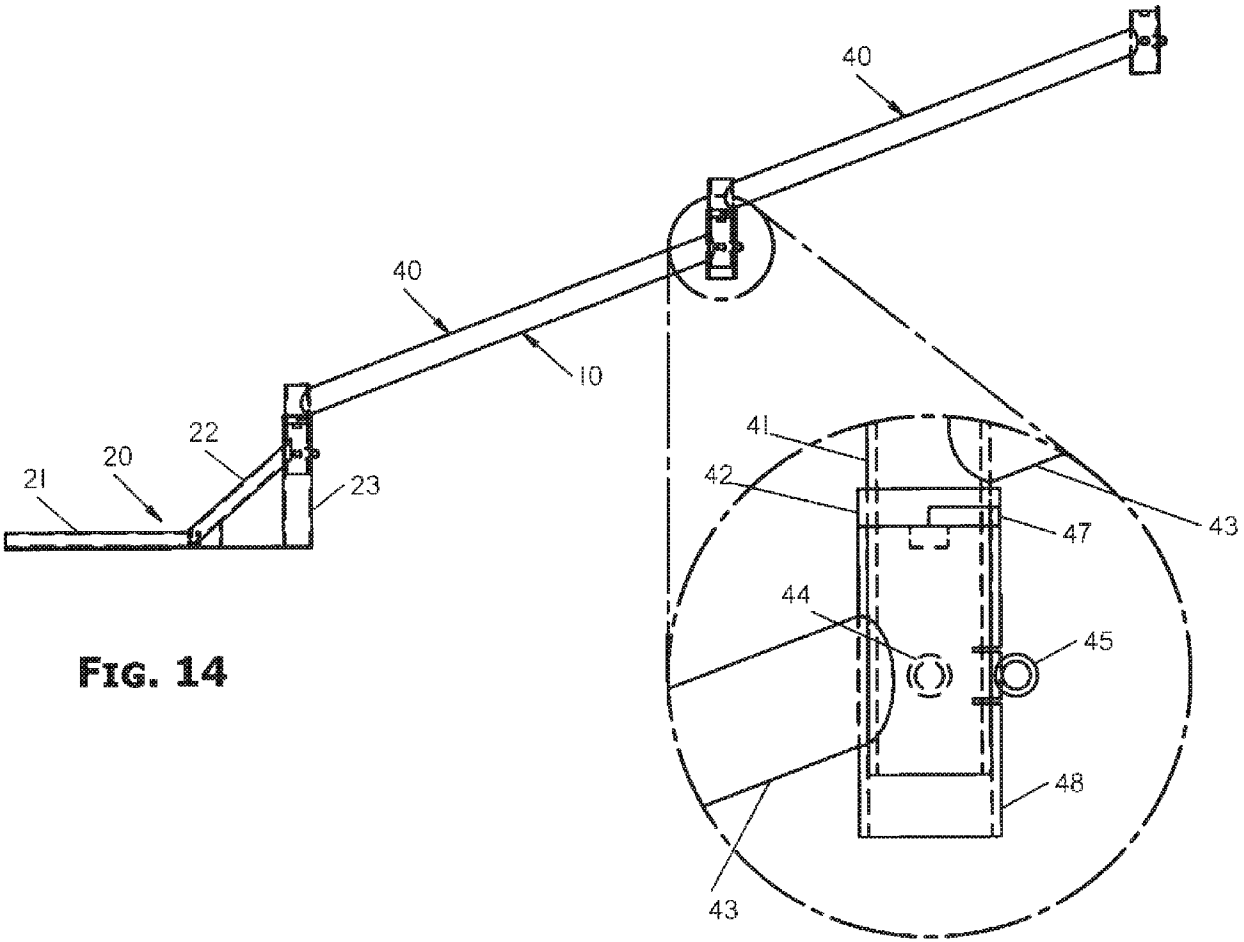
FIG. 14 is a side view of a vehicle anchored accessory holder according to the present invention.
FIG. 14A is a detailed side view of a connection between two extension arms of a vehicle anchored accessory holder according to the present invention.
Figure 15:
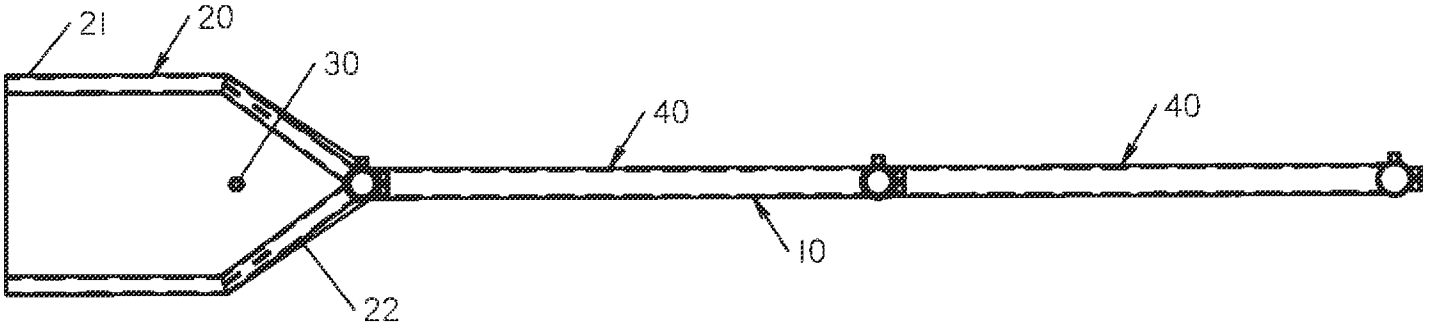
FIG. 15 is a top plan view of the vehicle anchored accessory holder illustrated in FIG. 14.
Figure 16:
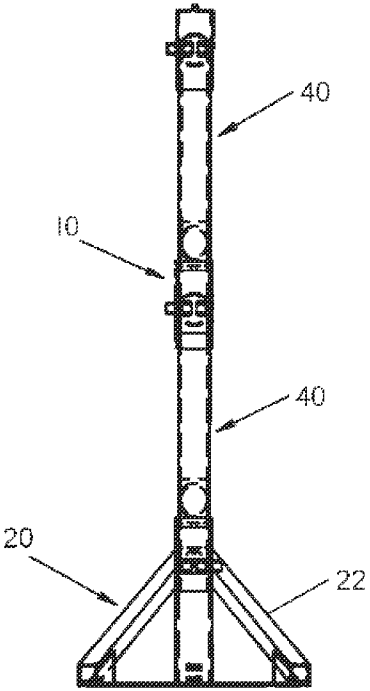
FIG. 16 is a front elevation view of the vehicle anchored accessory holder illustrated in FIG. 14.

FIGS. 11-13 and 17 illustrate a portion of the vehicle anchored accessory holder 10 that is adapted to secure either an accessory or an extension arm stem 41 in place. Referring to FIGS. 11-13, the accessory shaft clamp portion 70 of the vehicle anchored accessory holder 10 according to the present invention is illustrated. The accessory shaft clamp portion 70 may include a cross member 74 with a contact member 72 connected to a first edge 75 of the cross member 74 and extending downwardly therefrom. A guide member 71 may be connected to a second edge 76 of the cross member 74 and extend downwardly therefrom opposite the first edge. A guide hole 73 may be provided on the guide member 71, as perhaps best illustrated in FIGS. 11 and 12. The guide hole 73 may be positioned on the guide member 71 so as to permit a connector to pass therethrough and contact the contact member 72. After having had the benefit of reading this disclosure, those skilled in the art will appreciate that the contact member 72 and guide member 71, while depicted in FIGS. 11-13, and 17 as having slightly convex profiles, may be of a square-shaped profile, triangular-shaped profile, star-shaped profile, trapezoidal-shaped profile or any other-shaped profile in order to evenly contact an appropriately shaped shaft, while still accomplishing the goals, features and objectives according to the present invention.

Figure 17:
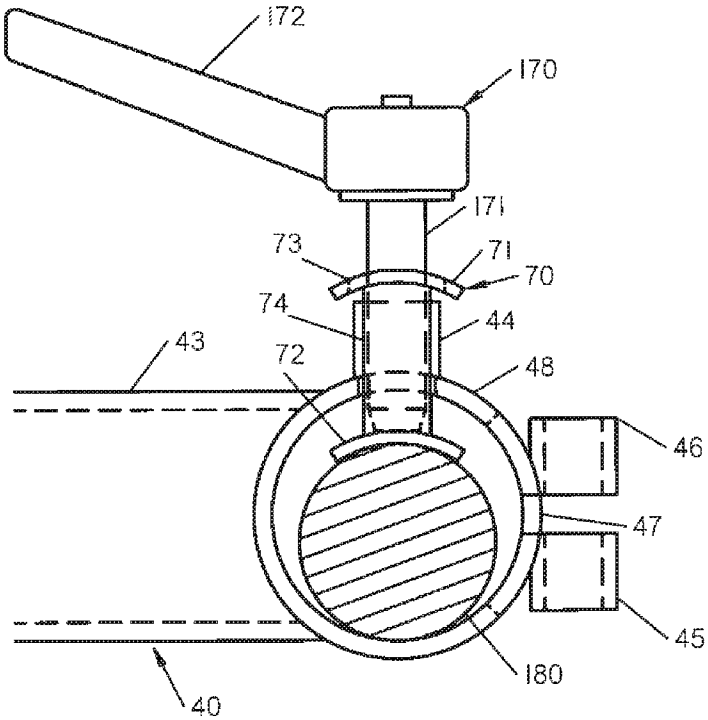
FIG. 17 is a partial detailed top plan view of an opening of a portion of a vehicle anchored accessory holder for receiving an accessory to be supported according to the present invention.
Figure 18:
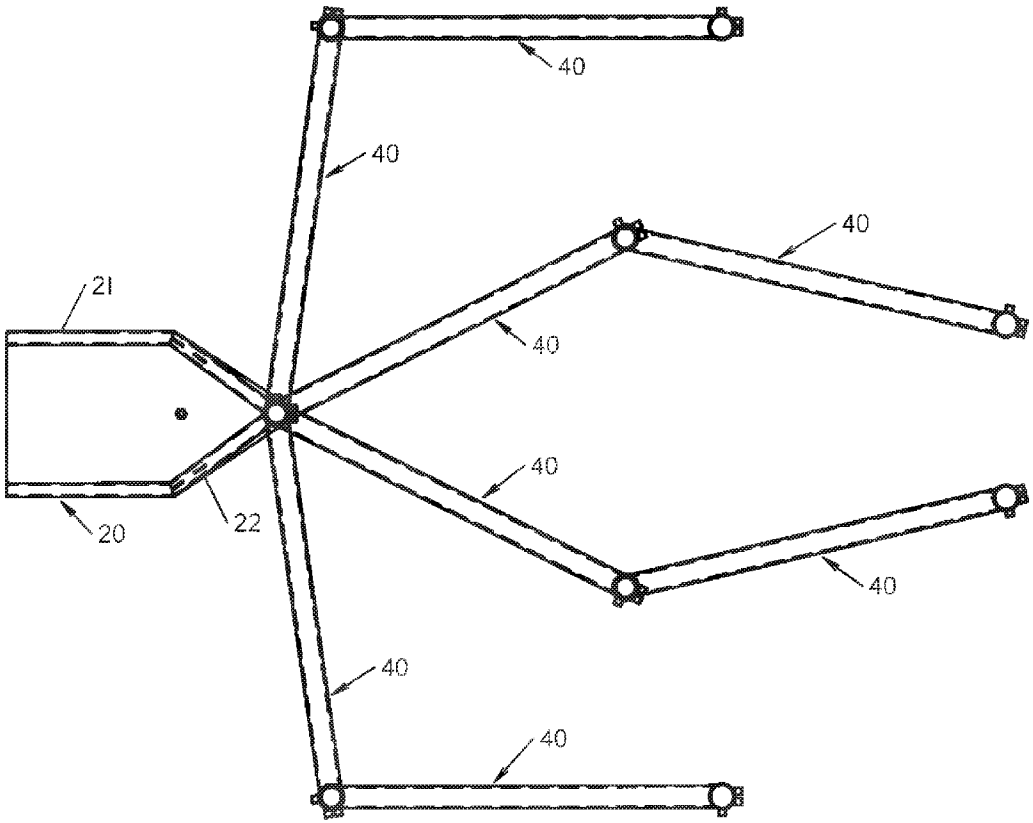
FIG. 18 is a top plan view of an assembled vehicle anchored accessory holder showing the arm in various positions illustrating examples of range according to the present invention.

FIG. 17 illustrates a detail of the female fitting 48 of the extension arm portion 40 of the vehicle anchored accessory holder 10 according to the present invention supporting an accessory by use of an accessory connector portion 170. The accessory connector portion 170 of the vehicle anchored accessory holder 10 is now described in greater detail. The accessory connector portion 170 may include a connector 171 and a handle 172 optionally connected thereto. The handle 172, as understood by those skilled in the art, may be used in conjunction with the accessory connector portion 170 of the vehicle anchored accessory holder 10, to provide a larger gripping surface to tighten or loosen the connector 171. The connector 171 may have threads on the exterior surface thereof. The connector 171 may be passed through the guide hole 73 in the guide member 71 and then passed through the collar 44 of the female fitting 48 to contact a first surface of the contact member 72. The connector 171 may be rotated in a manner so that the threads on the exterior surface thereof, in conjunction with the threads on the interior surface of the collar 44, cause the connector 171 to be driven toward the interior of the female fitting 48 causing a second surface of the contact member 72 to be forced against an accessory 180. The vehicle anchored accessory holder 10 according to the present invention advantageously permits an accessory of any size smaller than the opening of the female fitting 23 or female fitting 48 to be securely supported therein.

FIGS. 14-16 and 18 illustrate a base plate portion 20 selectively connected to a first extension arm portion 40 which is selectively connected to a second extension arm portion 40 of the vehicle anchored accessory holder 10 according to the present invention. The extension arm stem 41 of the first extension arm portion 40 may be inserted into the female fitting 23 of the base plate portion 20. The extension arm stem 41 of the second extension arm portion 40 may be inserted into the female fitting 48 of the first extension arm portion 40. FIG. 14A illustrates a detail of the connection between the first extension arm portion 40 and the second extension arm portion 40. The tab 47 on the lip of the female fitting 48 of the first extension arm portion 40 may fit into the groove 49 on the flange 42 of the second extension arm portion 40. The range of motion of the extension arm portion 40 will be limited by the length of the groove 49 and the movement of the tab 47 therein. This junction advantageously provides a stable and movable joint, as perhaps best illustrated in FIG. 18, while preventing contact between the extension arm portion 40 and the vehicle. Accordingly, the vehicle anchored accessory holder 10 may advantageously provide a great range of motion so that various accessories may be used in various positions as desired. After having had the benefit of reviewing this disclosure, those skilled in the art will appreciate that the number of extension arm portions 40 used in connection with the base plate portion 20 may vary according to the needs of the user, while still accomplishing the goals, features and objectives according to the present invention. The tab 29 is similar in function to the tab 47, i.e., the tab 29 is adapted to engage the groove 49 in the flange 42. Accordingly, and as will be discussed in greater detail below, the tab 29 may rotate within the groove 49, which is formed along an exterior portion of the extension arm stem 41. The tab 29 allows rotation within a predetermined range of the extension arm portion 40 relative to the female fitting 23.

Figure 19:
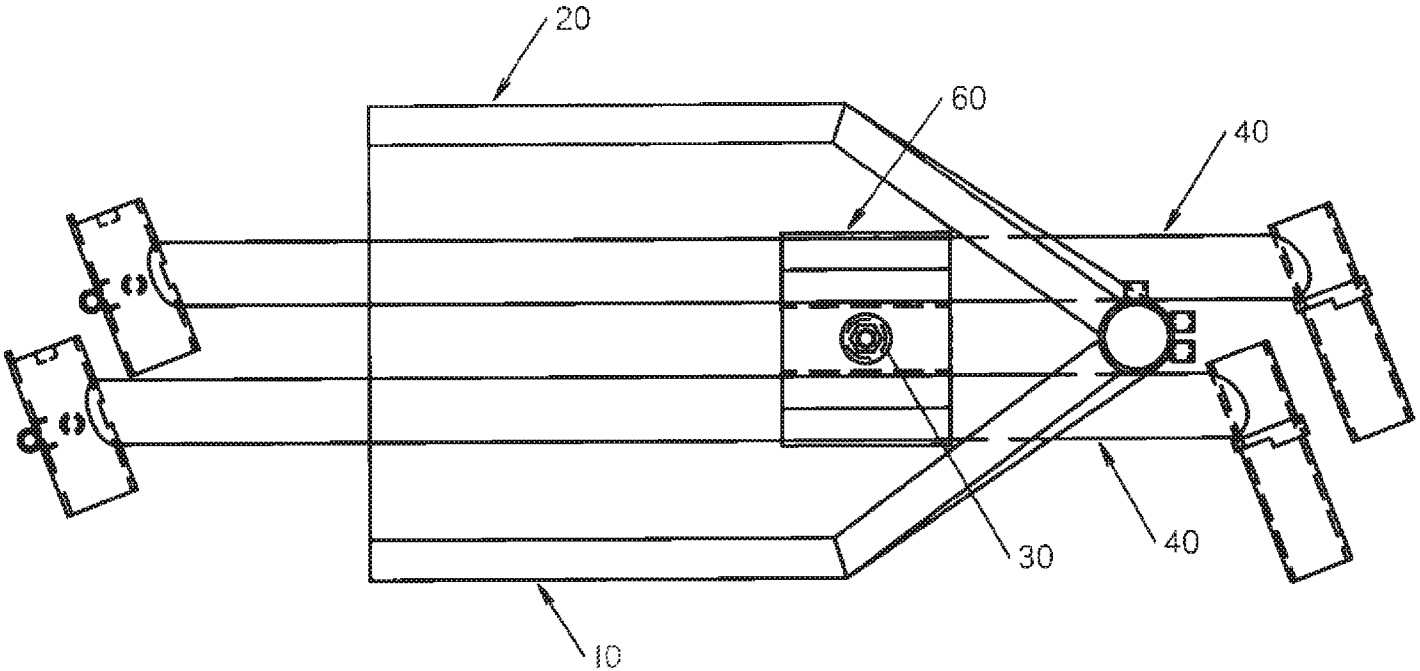
FIG. 19 is a top plan view of a collapsed vehicle anchored accessory holder according to the present invention having the extension arms stowed by use of a storage bracket.
Figure 20:
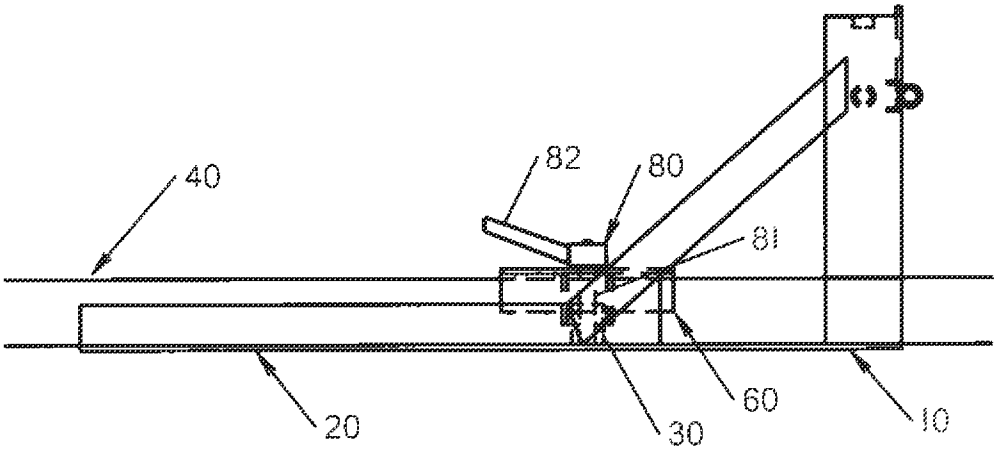
FIG. 20 is a partial side elevation view of the collapsed vehicle anchored accessory holder illustrated in FIG. 19 and showing an optional handle.
Figure 21:
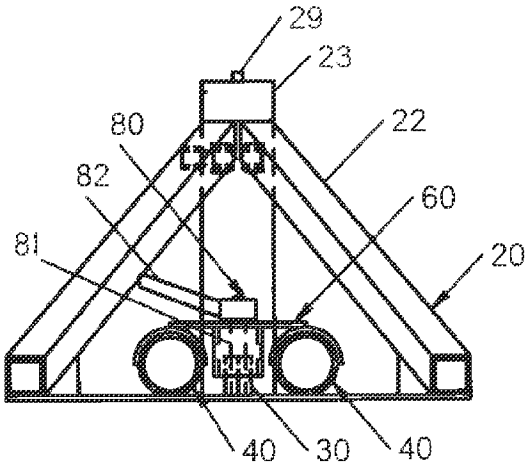
FIG. 21 is a rear elevation view of the collapsed vehicle anchored accessory holder illustrated in FIG. 20.

FIGS. 19-21 illustrate the base plate portion 20 selectively connected to two extension arm portions 40 by use of the storage bracket portion 60 and a storage connector portion 80 of the vehicle anchored accessory holder 10 according to the present invention. The storage connector portion 80 of the vehicle anchored accessory holder 10 is now described in greater detail. The storage connector portion 80 may include a connector 81 and a handle 82 optionally connected thereto. The handle 82, as understood by those skilled in the art, may be used in conjunction with the storage connector portion 80 of the vehicle anchored accessory holder 10, to provide a larger gripping surface to tighten or loosen the connector 81. The connector 81 may have threads on the exterior surface thereof. The connector 81 may be passed through the connector passageway 64 in the base 61 to interface with the fastener 30 in the base 28. The connector 81 may be rotated in a manner so that the threads on the exterior surface thereof, in conjunction with the threads on the interior surface of the fastener 30, cause the connector 81 to be driven toward the surface of the base 28 resulting in an application of pressure to an upper surface of the base 61. As pressure is increased on the upper surface of the base 61, the accessory cradles 62 are forced against an upper surface of the extension arms 43. As pressure is increased on the upper surface of the extension arms 43, the extension arms are forced against the upper surface of the base 28. The vehicle anchored accessory holder 10 according to the present invention may advantageously be readily configured in a collapsed position for the compact and self-contained storage thereof using the storage bracket portion 60.

Figure 22:
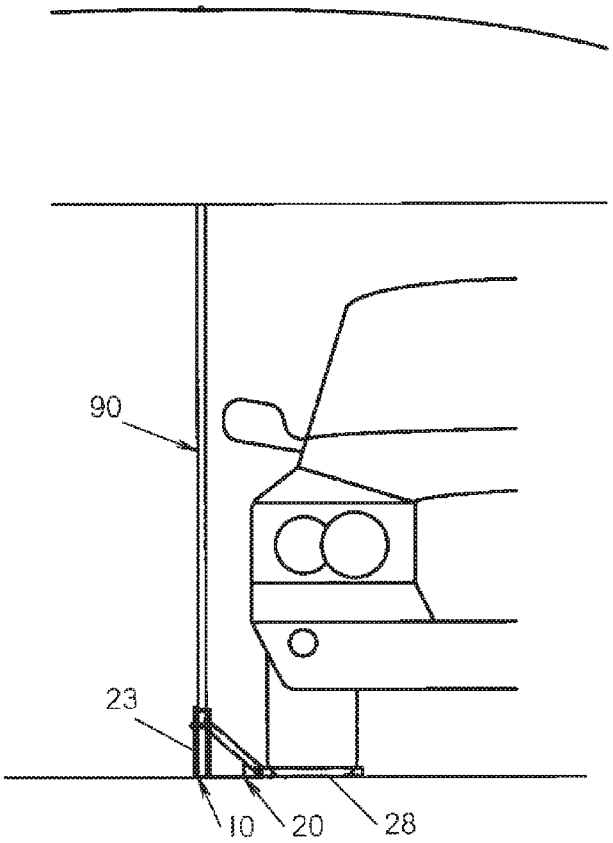
FIG. 22 is a partial environmental side view of a vehicle anchored accessory holder according to the present invention supporting an optional umbrella attachment accessory and installed beneath a vehicle wheel.
Figure 23:
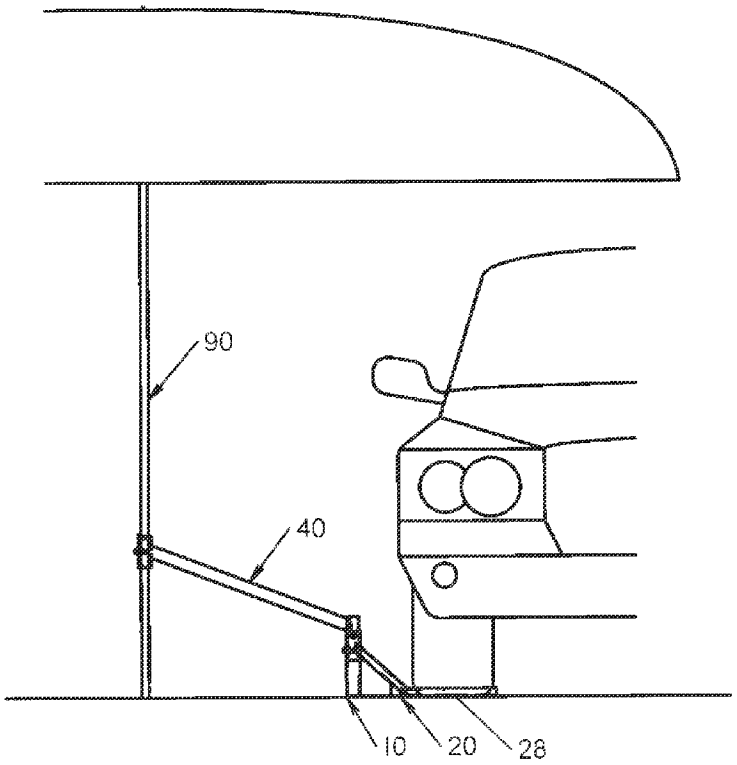
FIG. 23 is a partial environmental side view of the vehicle anchored accessory holder illustrated in FIG. 22 with one extension arm.
Figure 24:
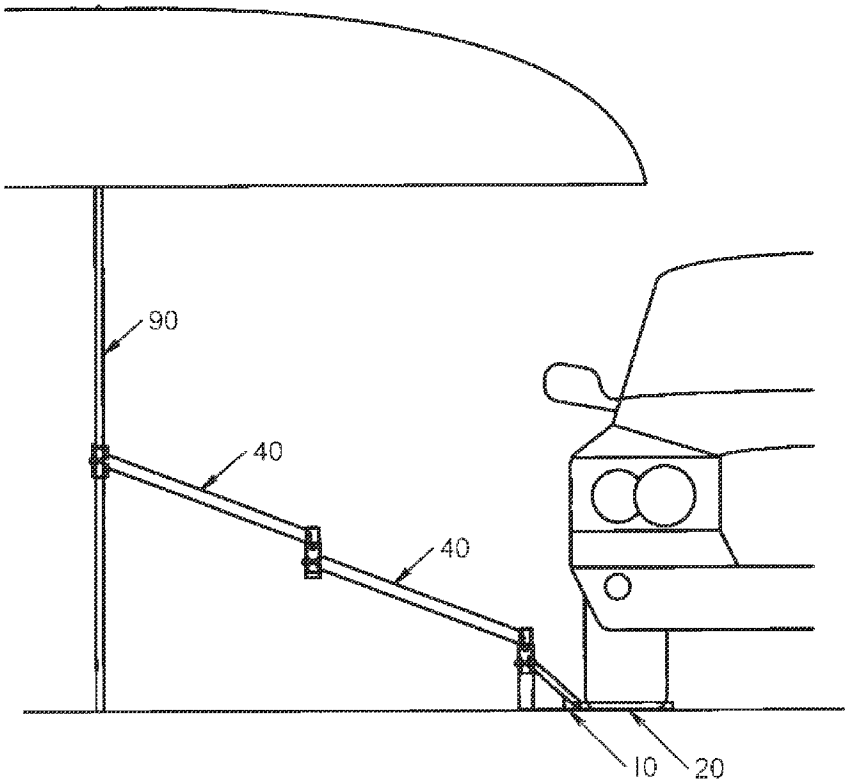
FIG. 24 is a partial environmental side view of the vehicle anchored accessory holder illustrated in FIG. 22 with two extension arms.

FIGS. 22-30 illustrate various embodiments of the vehicle anchored accessory holder 10 according to the present invention supporting accessories. FIG. 22 illustrates the base portion 20 of the vehicle anchored accessory holder 10 supporting an umbrella accessory 90. The vertical shaft of the umbrella accessory 90 is inserted into the female fitting 23. A vehicle wheel is positioned over the base 28 to provide an anchor for the vehicle anchored accessory holder 10. FIG. 23 illustrates the base plate portion 20 selectively connected to the extension arm portion 40 supporting the umbrella accessory 90. The vertical shaft of the umbrella accessory 90 is inserted into the female fitting 48. A vehicle wheel is positioned over the base 28 to provide an anchor for the vehicle anchored accessory holder 10. FIG. 24 illustrates the base plate portion 20 selectively connected to a first extension arm portion 40 which is selectively connected to a second extension arm portion 40 supporting the umbrella accessory 90. The vertical shaft of the umbrella accessory 90 is inserted into the female fitting 48 of the second extension arm portion 40. A vehicle wheel is positioned over the base 28 to provide an anchor for the vehicle anchored accessory holder 10.

Figure 25:
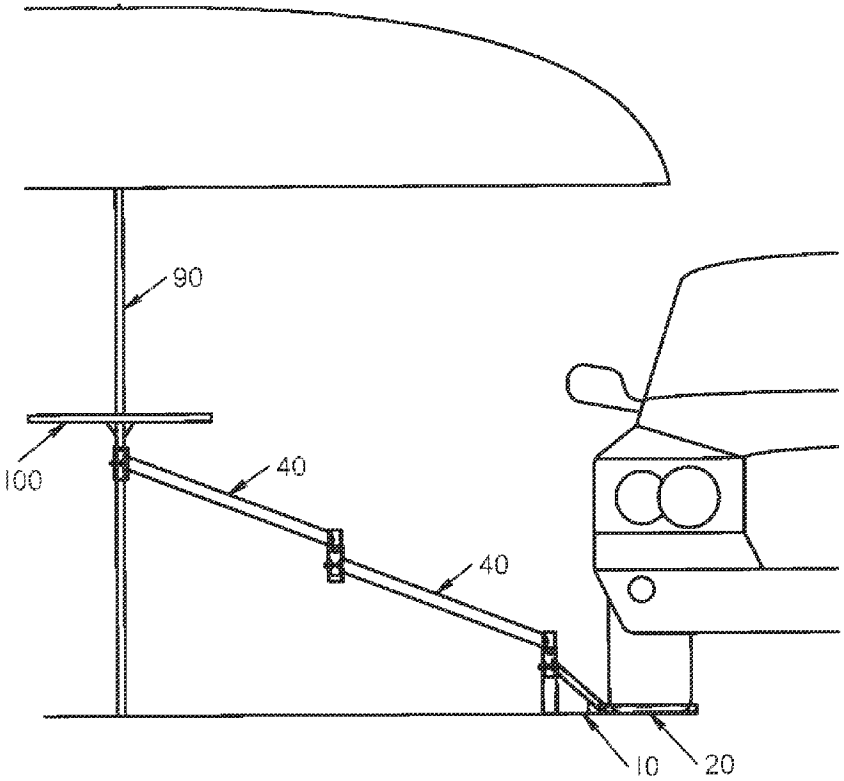
FIG. 25 is a partial environmental side view of the vehicle anchored accessory holder illustrated in FIG. 22 with two extension arms and an optional table attachment accessory.
Figure 26:
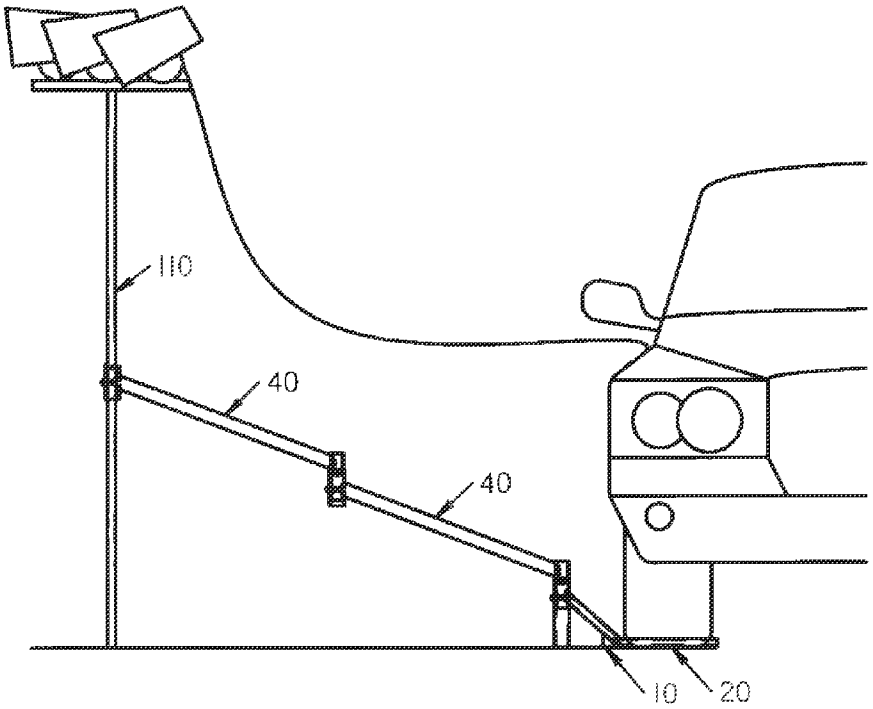
FIG. 26 is a partial environmental side view of the vehicle anchored accessory holder illustrated in FIG. 22 with two extension arms and an optional light array attachment accessory.
Figure 27:
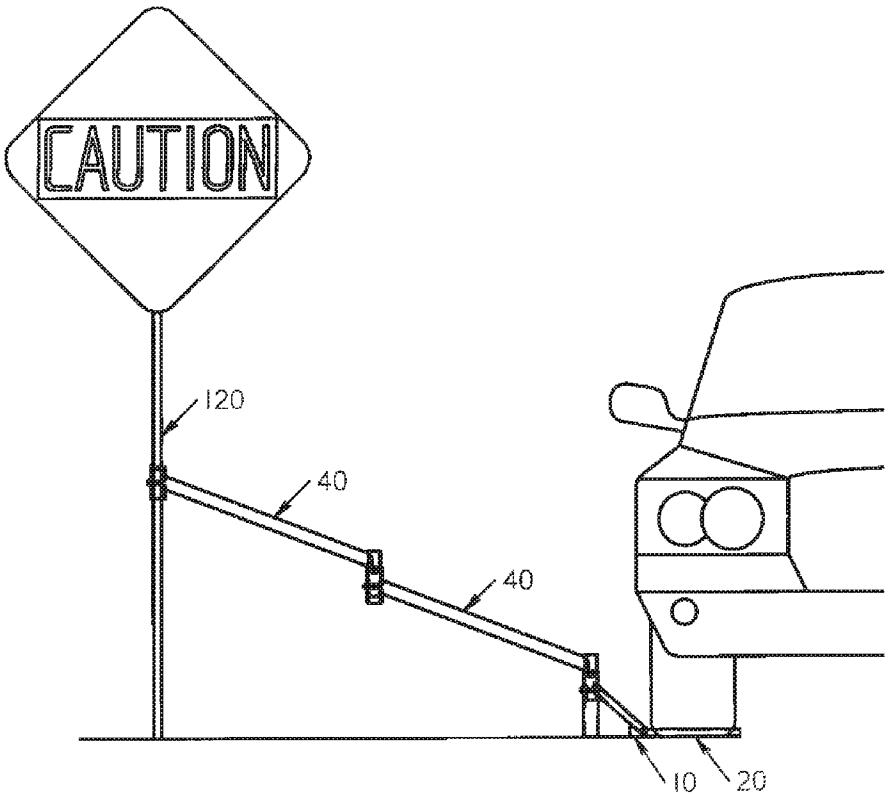
FIG. 27 is a partial environmental side view of the vehicle anchored accessory holder illustrated in FIG. 22 with two extension arms and an optional sign attachment accessory.

FIG. 25 illustrates the base plate portion 20 selectively connected to a first extension arm portion 40 which is selectively connected to a second extension arm portion 40 supporting the umbrella accessory 90 and an optional table attachment accessory 100. The vertical shaft of the umbrella accessory 90 is inserted into the female fitting 48 of the second extension arm portion 40. A vehicle wheel is positioned over the base 28 to provide an anchor for the vehicle anchored accessory holder 10. FIG. 26 illustrates the base plate portion 20 selectively connected to a first extension arm portion 40 which is selectively connected to a second extension arm portion 40 supporting an optional light array attachment accessory 110. The vertical shaft of the light array attachment accessory 110 is inserted into the female fitting 48 of the second extension arm portion 40. A vehicle wheel is positioned over the base 28 to provide an anchor for the vehicle anchored accessory holder 10. FIG. 27 illustrates the base plate portion 20 selectively connected to a first extension arm portion 40 which is selectively connected to a second extension arm portion 40 supporting an optional sign attachment accessory 120. The vertical shaft of the sign attachment accessory 120 is inserted into the female fitting 48 of the second extension arm portion 40. A vehicle wheel is positioned over the base 28 to provide an anchor for the vehicle anchored accessory holder 10.

Figure 28:
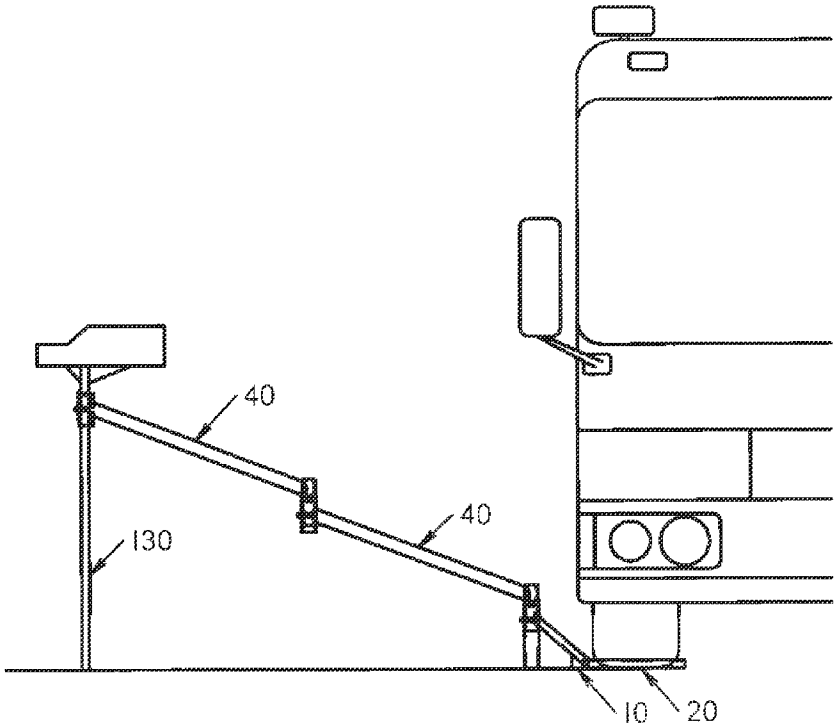
FIG. 28 is a partial environmental side view of the vehicle anchored accessory holder illustrated in FIG. 22 with two extension arms and an optional grill attachment accessory.
Figure 29:
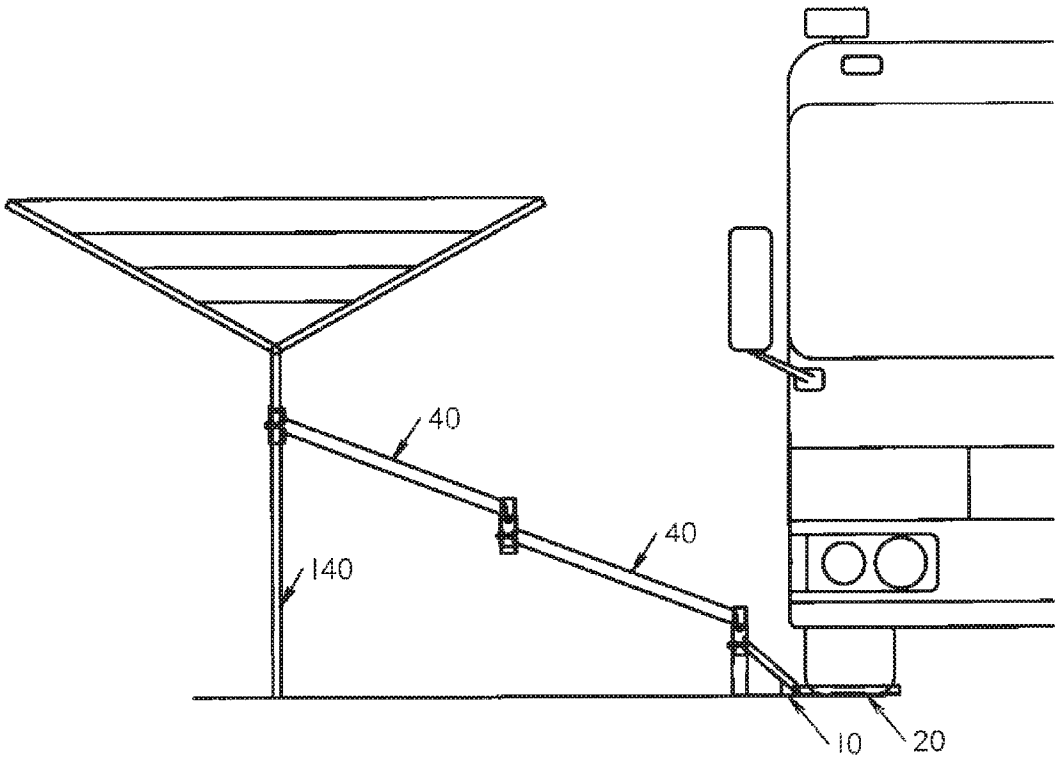
FIG. 29 is a partial environmental side view of the vehicle anchored accessory holder illustrated in FIG. 22 with two extension arms and an optional clothesline attachment accessory.

FIG. 28 illustrates the base plate portion 20 selectively connected to a first extension arm portion 40 which is selectively connected to a second extension arm portion 40 supporting an optional grill attachment accessory 130. The vertical shaft of the grill attachment accessory 130 is inserted into the female fitting 48 of the second extension arm portion 40. A vehicle wheel is positioned over the base 28 to provide an anchor for the vehicle anchored accessory holder 10. FIG. 29 illustrates the base plate portion 20 selectively connected to a first extension arm portion 40 which is selectively connected to a second extension arm portion 40 supporting an optional clothesline attachment accessory 140. The vertical shaft of the clothesline attachment accessory 140 is inserted into the female fitting 48 of the second extension arm portion 40. A vehicle wheel is positioned over the base 28 to provide an anchor for the vehicle anchored accessory holder 10.

Figure 30:
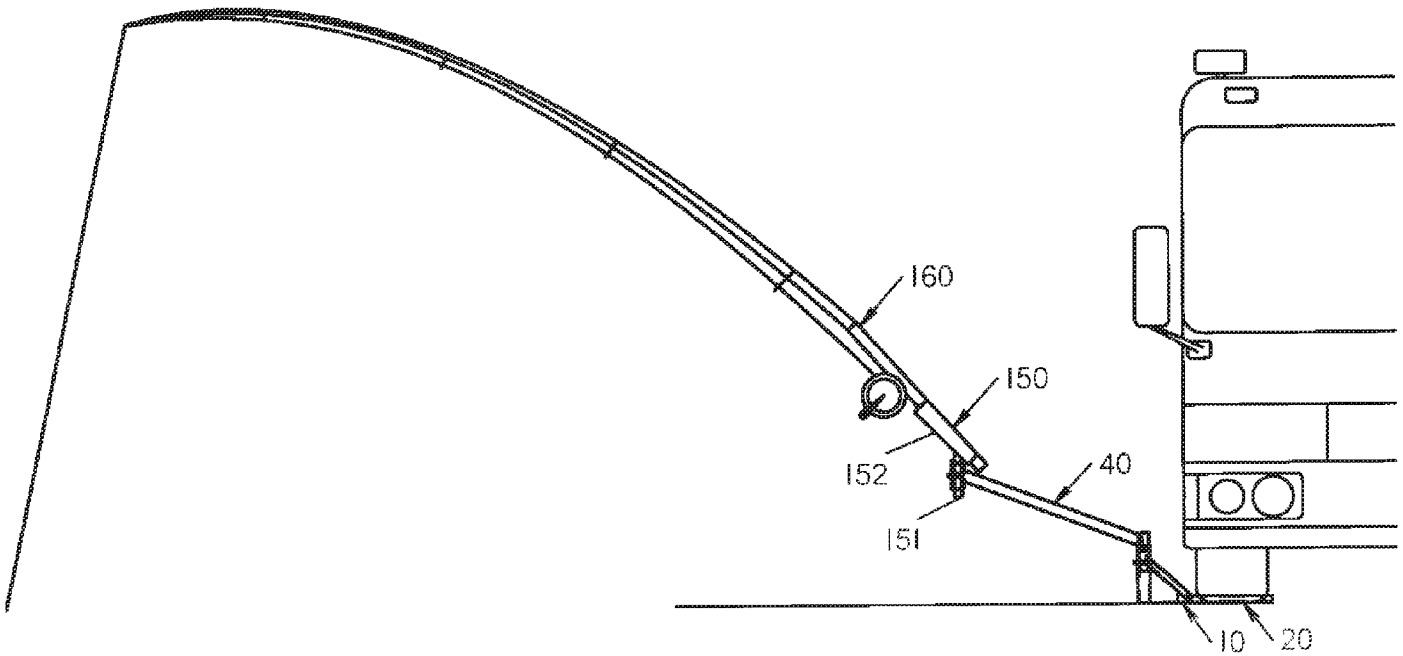
FIG. 30 is a partial environmental side view of the vehicle anchored accessory holder illustrated in FIG. 22 with two extension arms and an optional fishing pole attachment accessory.

FIG. 30 illustrates the base plate portion 20 selectively connected to a first extension arm portion 40 which is selectively connected to a second extension arm portion 40 supporting an optional fishing rod attachment accessory 160 by use of a fishing rod holder portion 150. The fishing rod holder portion 150 may include a vertical shaft 151 and a rod holder 152 connected thereto at an upper end of the vertical shaft 151. The vertical shaft 151 is inserted into the female fitting 48 of the second extension arm portion 40. The fishing rod attachment accessory 160 is inserted into the rod holder 152. A vehicle wheel is positioned over the base 28 to provide an anchor for the vehicle anchored accessory holder 10.

Figure 31:
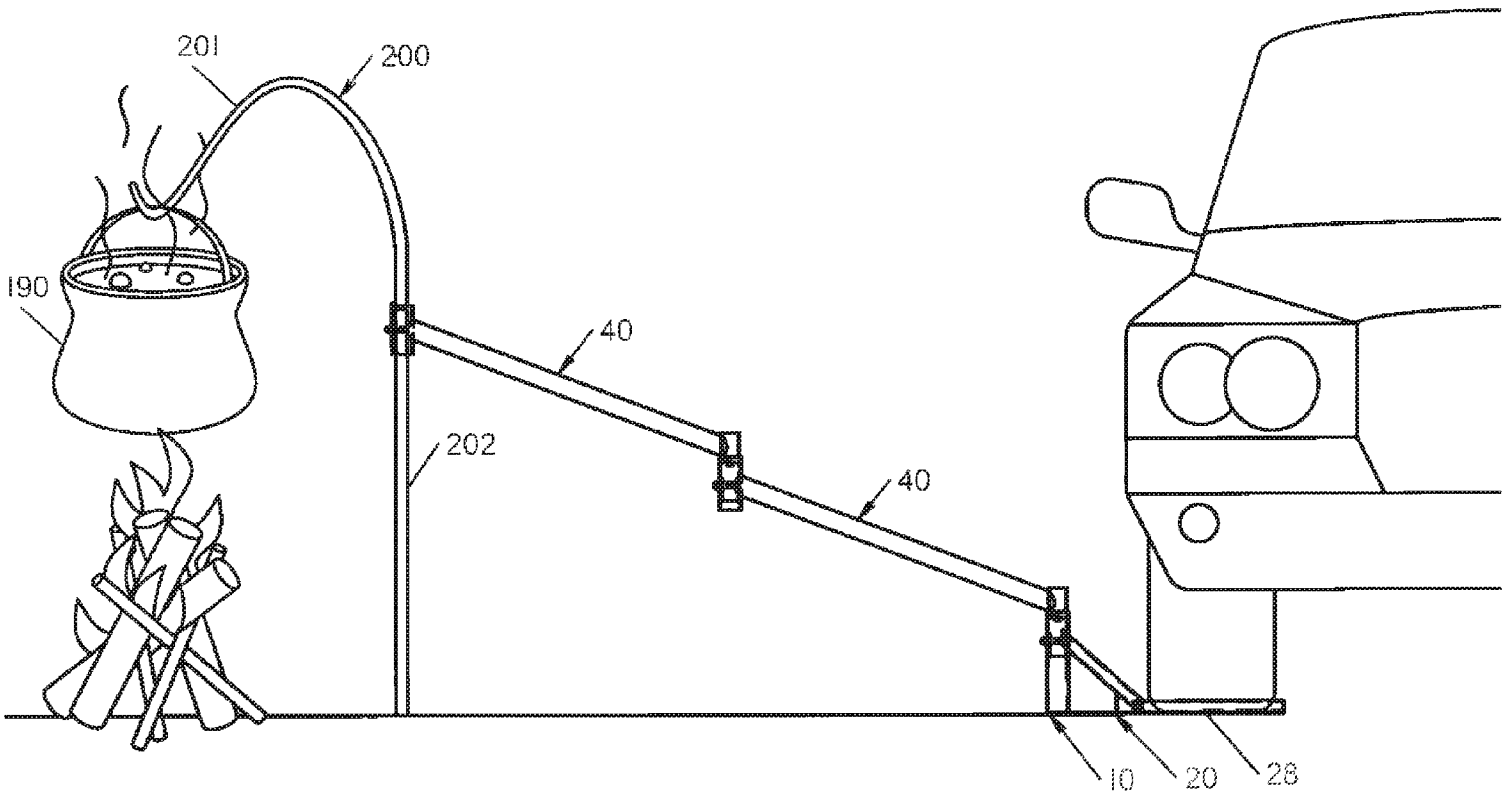
FIG. 31 is a partial environmental side view of the vehicle anchored accessory holder illustrated in FIG. 22 with two extension arms and an optional pot holder attachment accessory.
Figure 32:
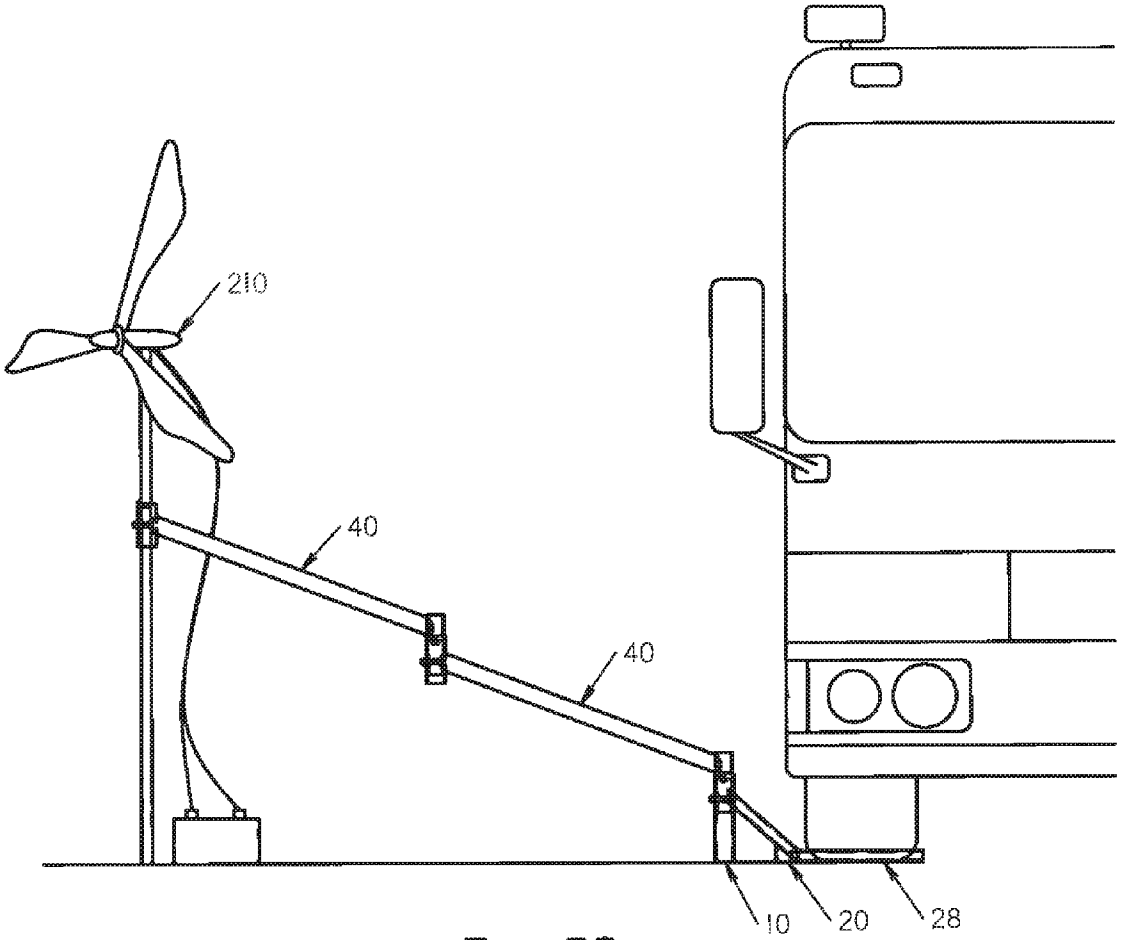
FIG. 32 is a partial environmental side view of the vehicle anchored accessory holder illustrated in FIG. 22 with two extension arms and an optional wind turbine attachment accessory.

FIG. 31 illustrates the base plate portion 20 selectively connected to a first extension arm portion 40 which is selectively connected to a second extension arm portion 40 supporting an optional pot attachment accessory 190 by use of a pot holder portion 200. The pot holder portion 200 includes a hook 201 connected to a vertical shaft 202. The vertical shaft 202 of the pot holder portion 200 is inserted into the female fitting 48 of the second extension arm portion 40. The pot attachment accessory 190 may be suspended from the hook 201. A vehicle wheel is positioned over the base 28 to provide an anchor for the vehicle anchored accessory holder 10. FIG. 32 illustrates the base plate portion 20 selectively connected to a first extension arm portion 40 which is selectively connected to a second extension arm portion 40 supporting an optional wind turbine attachment accessory 210. The vertical shaft of the wind turbine attachment accessory 210 is inserted into the female fitting 48 of the second extension arm portion 40. A vehicle wheel is positioned over the base 28 to provide an anchor for the vehicle anchored accessory holder 10.

Figure 33:
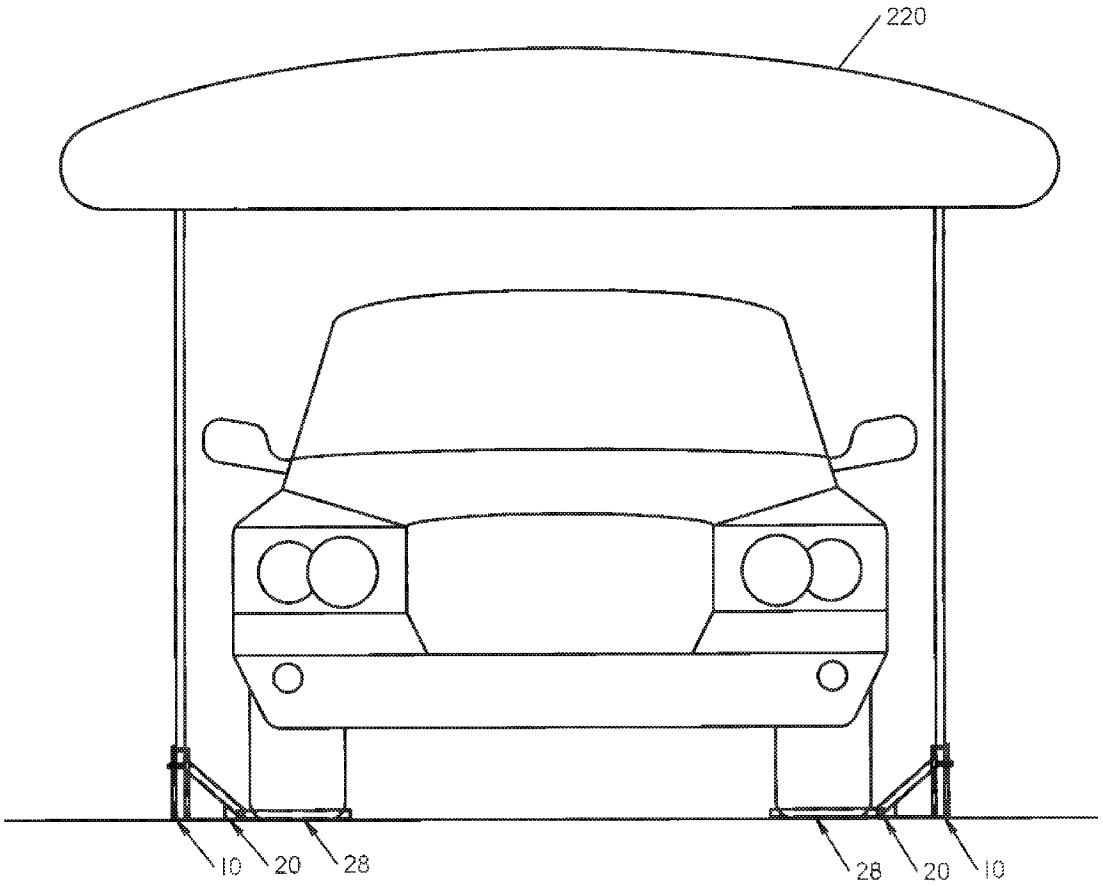
FIG. 33 is a side environmental view of two vehicle anchored accessory holders according to the present invention supporting an optional awning attachment accessory and installed beneath two wheels of a vehicle.

FIG. 33 illustrates two base plate portions 20 positioned under the two first front wheels of a vehicle and selectively connected to an awning attachment accessory 220. The vertical shafts of the awning attachment accessory 220 are inserted into the female fittings 23 of the base plate portions 20. After having had the benefit of reviewing this disclosure, those skilled in the art will appreciate that any number of base plate portions 20 could be used in connection with any number of vehicle wheels so as to position an awning attachment accessory over the front, rear, either side or over the entire vehicle, while still accomplishing the goals, features and objectives according to the present invention.

Figure 34:
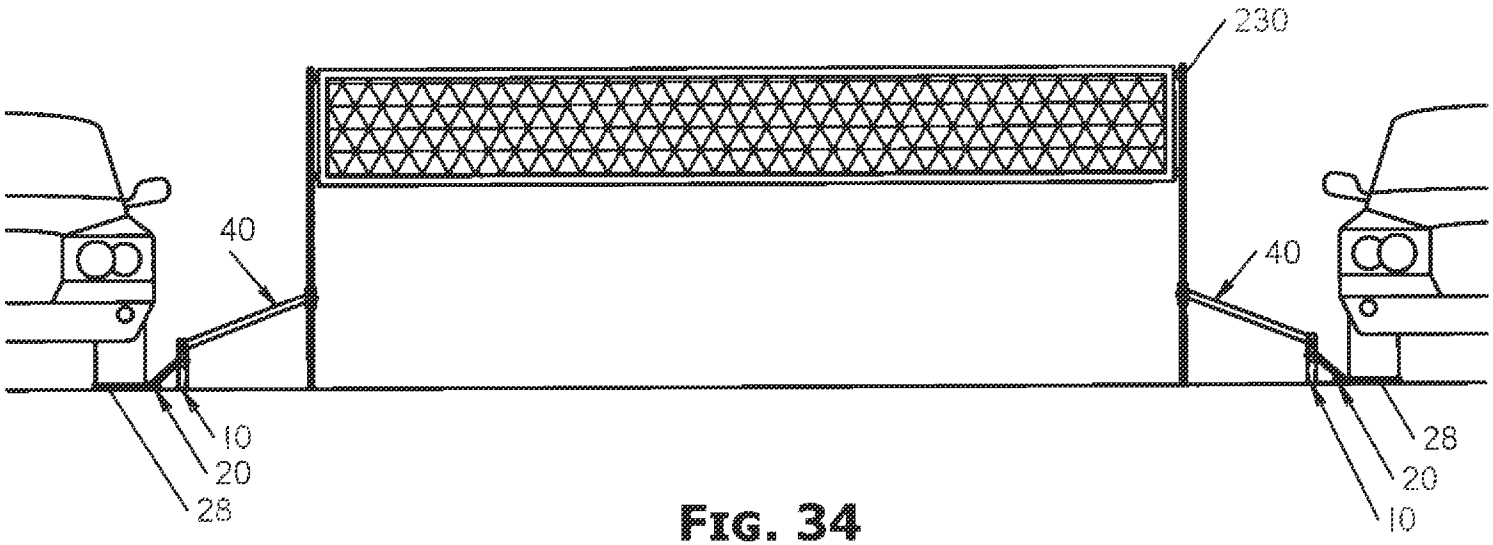
FIG. 34 is a partial environmental side view of two vehicle anchored accessory holders according to the present invention supporting an optional volleyball net attachment accessory and installed beneath the wheels of two vehicles.

FIG. 34 illustrates two extension arm portions 40 selectively connected to two base plate portions 20 positioned under the front wheels of two vehicles and selectively connected to a volleyball net attachment accessory 230. The vertical shafts of the volleyball net attachment accessory 230 are inserted into the female fittings 48 of the extension arm portions 40 with a net strung between the vertical shafts. After having had the benefit of reviewing this disclosure, those skilled in the art will appreciate that any number of attachments, including but not limited to badminton nets, banners and flags, could be selectively connected to the disclosed arrangement of base plate portions 20 and extension arm portions 40 while still accomplishing the goals, features and objectives according to the present invention.

Figure 35:
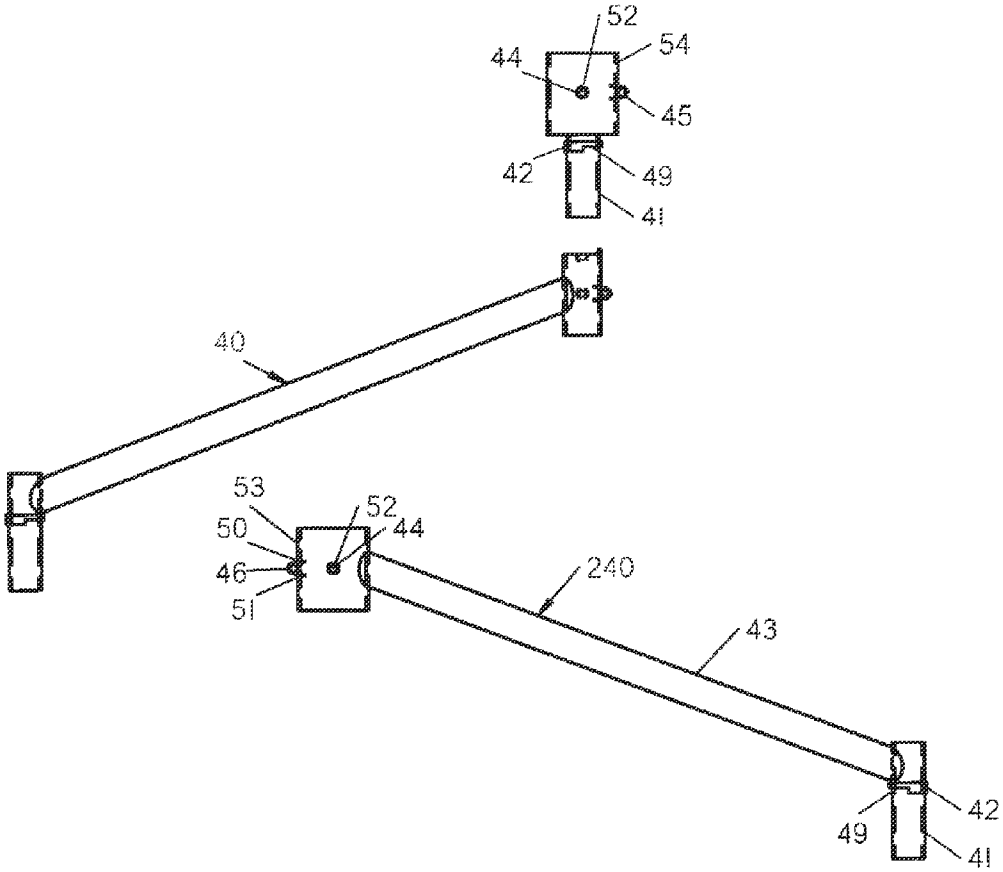
FIG. 35 is a side view of a vehicle anchored accessory holder according to the present invention showing a wider female fitting attachment and an extension arm including a wider female fitting.

FIG. 35 illustrates a wider female fitting extension arm portion 240 and illustrates an optional wider female fitting attachment 54. The wider female fitting extension arm portion 240 includes the extension arm stem 41, the flange 42, the groove 49 and the extension arm 43 identical in function to the similarly labeled components of the extension arm portion 40 which need not be discussed further. The wider female fitting extension arm portion also includes a wider female fitting 53. The wider female fitting 53 includes the opening 52, the collar 44, the first tube 45, the second tube 46, the first slot 50, and the second slot 51 identical in function to the similarly labeled components of the extension arm portion 40 which need not be discussed further. The surface of the wider female fitting 53 between the first tube 45, the second tube 46, the first slot 50 and the second slot 51 may be absent. The optional wider female fitting attachment 54 includes the extension arm stem 41, the flange 42 and the groove 49 identical in function to the similarly labeled components of the extension arm portion 40 which need not be discussed further. The optional wider female fitting attachment 54 also includes the opening 52, the collar 44, the first tube 45, the second tube 46, the first slot 50, and the second slot 51 identical in function to the similarly labeled components of the extension arm portion 40 which need not be discussed further. The surface of the optional wider female fitting attachment 54 between the first tube 45, the second tube 46, the first slot 50 and the second slot 51 may be absent.

While FIGS. 22-33 variously depict the base plate portion 20, a first extension arm 40 or a second extension arm 40 supporting an accessory, after having had the benefit of reviewing this disclosure, those skilled in the art will appreciate that the number of extension arm portions 40 used in connection with the base plate portion 20 to support an accessory may vary according to the needs of the user, while still accomplishing the goals, features and objectives according to the present invention.

While threaded connectors have been disclosed as suitable connectors for securing attachments or extension arm stems 41 in female fittings 23, 48, 53 and 54, those skilled in the art will appreciate that any number of connectors, including but not limited to spring clips, cotter pins and other connectors, may be used in conjunction with appropriately modified attachments, extension arm stems 41 and female fittings 23, 48, 53 and 54, while still accomplishing the goals, features and objectives according to the present invention.

A non-limiting example of a method of assembling, using, and disassembling the vehicle anchored accessory holder 10, according to the present invention, is now described. Starting with the stowed and collapsed vehicle anchored accessory holder 10 illustrated in FIGS. 19-21, a user can optionally remove the storage connector portion 80, thereby freeing the base plate portion 20 and the two extension arm portions 40 from the storage bracket portion 60. It would be apparent to those having skill in the art, after having the benefit of this disclosure, that the vehicle anchored accessory holder 10 may be stored in, as an example, but not meant as a limitation, its stowed and collapsed state, or may be stored without use of the storage connector portion 80 and storage bracket portion 60.

After optionally freeing the base plate portion 20 and the two extension arm portions 40 from the storage bracket portion 60, a user may place the base plate portion 20 on the ground. After placing the base plate portion 20 on the ground, a user may position a vehicle wheel on the base 28. After positioning a vehicle wheel on the base 28, a user may insert in the female fitting 23 an accessory, an extension arm portion 40, a wider female fitting extension arm portion 240, or a wider female fitting 54.

Once a user has inserted into the female fitting 23 the desired accessory or piece, it can be determined whether there are additional pieces to be assembled before enjoying use of the accessory. It would be apparent to a person having skill in the art, after having the benefit of this disclosure, that the use of a particular accessory may require fewer or more pieces to be assembled in order to enjoy its use. As a non-limiting example, the pot holder portion 200 generally requires the use of a flame or other heating source which, for safety reasons, would generally require assembly of the base plate portion 20, with two extension arm portions 40 in order to create a safe distance between the heating source and the vehicle. If it is determined that there is at least one piece remaining to be assembled, the next piece can be optionally added to the assemblage.

Otherwise, if it is determined that there are no additional pieces to be assembled, it can be determined whether it is necessary to secure the accessory within the female fitting by use of the accessory connector portion 170. It would be apparent to a person having skill in the art, after having the benefit of this disclosure, that the use of a particular accessory may or may not require that the accessory be secured in order to enjoy its use. As a non-limiting example, the wind turbine attachment accessory 210 may require the ability to rotate in order to face into the prevailing winds. If it is determined that securing the accessory within the female fitting adds to the enjoyment of the accessory, the accessory connector portion 170 may be used. Otherwise if it is determined that it is not necessary to secure the accessory within the female fitting, a user may enjoy the use of the accessory.

After enjoying the use of the accessory, a user may grasp the accessory. If it is determined that the accessory connector portion 170 was used to secure the accessory within the female fitting, a user may remove the accessory connector portion. Otherwise, a user may remove the accessory from the female fitting. After removing the accessory from the female fitting, a user may disassemble the pieces so that a base plate portion 20, two extension arm portions 40 and the storage bracket portion 60 are freed. Once a user has freed the base plate portion 20, two extension arm portions 40 and storage bracket portion 60, the user may store the disassembled pieces or may optionally stow the disassembled pieces by use of the storage bracket portion 60 and storage connector 80.

If a user determines to stow the disassembled pieces, a user may optionally place the two extension arm portions 40 across the base plate portion 20. After placing the two extension arm portions 40 across the base plate portion 20, a user may place the storage bracket portion 60 on top of the two extension arm portions 40. After placing the storage bracket portion 60 on top of the two extension arm portions 40, a user may insert the storage connector portion 80 through the storage bracket portion 60 and into the fastener 30. After inserting the storage connector portion 80 into the fastener 30, a user may apply a rotational force to the storage connector portion 80 in order to secure the two extension arm portions 40 between the base plate portion 20 and the storage bracket portion.

The vehicle anchored accessory holder 10 according to the present invention is now described in greater detail. The vehicle anchored accessory holder 10 may comprise a base plate 28, which may have a brace 27 connected to and extending upwardly from the base plate. An angled support 22 may be connected to the brace 27. The embodiment of the vehicle anchored accessory holder 10 depicted in the appended drawings illustrates a pair of opposing braces 27 that extend upwardly from the base plate 28, and a respective pair of angled supports 22 connected to each of the opposing braces. The angled supports 22 are also connected to the base plate 28 to provide support for each of the opposing braces 27. Those skilled in the art will appreciate that any number of braces 27 and angled supports 22 may be provided to achieve the goals, features and objectives of the present invention. A female fitting 23 may be connected to and extend upwardly from the base plate 28. The angled support 22 may extend upwardly at a predetermined angle from the base plate 28 to the upper portion of the female fitting 23.

As illustrated in the appended figures, the female fitting 23 may also be connected to the angled support 22 and may have an open top to receive, for example, an extension arm stem 41 or an accessory to be held therein. The embodiment of the vehicle anchored accessory holder 10 depicted in the appended figures shows the female fitting 23 being connected to the pair of angled supports 22 that extend upwardly from the base plate 28. The female fitting 23 may have an opening 31 in a first side thereof to receive a fitting connector that may be moveable between an engaged position and a disengaged position to secure either the extension arm stem 41 or the accessory. A first tube 25 and a second tube 26 may be connected to an upper portion of the female fitting 23 to receive a connector which may be adapted to move the female fitting between an opened position and a closed position. Each of the first 25 and second 26 tubes may be oriented substantially parallel to an upper surface of the base plate 28. The connector may, for example, be provided by a threaded member, and either the first tube 25, the second tube 26, or both the first and second tube may be threaded to receive the threaded member. The threaded member may, for example, be provided by a threaded screw, a threaded bolt, a thumb screw, or any other threaded member as understood by those skilled in the art. Those skilled in the art will also appreciate that the connector is not meant to be limited to a threaded member, but may be any type of connector that can readily be passed through the first 25 and second 26 tubes to move the female fitting 23 between the opened and the closed positions.

The closed position of the female fitting 23 is preferably defined by the diameter of the open top of the female fitting being decreased as the first 25 and second 26 tubes are moved closer to one another using the connector. The opened position of the female fitting 23 is preferably defined by the diameter of the open top of the female fitting being increased as the first 25 and second 26 tubes are moved away from one another. When the female fitting 23 is in the closed position, inner surface portions of the female fitting may be positioned closer to that which may be held by the female fitting, i.e., an accessory or an extension arm 43, as will be discussed in greater detail below.

In some embodiments of the vehicle anchored accessory holder 10 according to the present invention, the base plate 28 may have a substantially pentagonal shape defined by a bottom end and a top end. The bottom end may have a polygonal shape and the top end may have a triangular shape. The bottom end may be connected to the top end to define a monolithic unit. Those skilled in the art will appreciate that the pentagonal shaped monolithic base plate 28 illustrated in the appended drawings is not meant to be limiting. This shape is a preferred shape of the base plate 28, but the skilled artisan will readily recognize that the base plate may have any shape, i.e., square, rectangular, circular, elliptical, and still carry out the benefits, features, advantages and objectives according to the present invention.

The base plate 28 may include a first ridge 21 connected to a first edge 35 of the base plate and a second ridge 21 connected to a second edge 36 of the base plate. The second ridge 21 may be oriented substantially parallel to the first ridge 21. The first and second ridges 21 that are connected to the base plate 28 advantageously act as guides for a vehicle tire to be positioned on the base plate, and also provide enhanced stability and security to the vehicle anchored accessory holder 10. More specifically, and as previously discussed above, a vehicle tire may be positioned to overlie the base plate 28 of the vehicle anchored accessory holder 10, i.e., a user may move the vehicle so that the tire of the vehicle overlies the base plate. To ensure that the vehicle tire is appropriately positioned to overlie the base plate 28, it is preferable that the tire be positioned between the first and second ridges 21, i.e., that one of the ridges is positioned in front of the tire and the other of the ridges is positioned behind the tire. Although the vehicle anchored accessory holder 10 is described as being anchored using a tire, those skilled in the art will appreciate that any type of weight may be readily used to anchor the vehicle anchored accessory holder 10 according to the present invention. For example, a user may desire to move their vehicle, but to still maintain the vehicle anchored accessory holder 10 in place. In such a case, the user may simply place any type of weighted material on the base plate 28 to keep secure the base plate in place. For example, the user may position a plurality of sandbags, bricks, concrete masonry units, or any other type of dense and weighted member over the base plate 28 to provide the weight necessary to hold the base plate in place, as understood by those skilled in the art. As discussed above, the angled support 22 may include a first angled support 22 connected to the base plate 28 adjacent the first edge 35 and a second angled support 22 connected to the base plate adjacent the second edge 36.

A collar 24 may surround the opening 31 in the first side of the female fitting 23. The collar 24 may have a threaded inner surface and a fitting connector that preferably has a threaded exterior surface may be used to engage the collar 24. The fitting connector may threadably engage the collar 24. The fitting connector may be provided by any type of threaded member such as, for example, a screw, a bolt, a thumb screw, or any other type of threaded connector that is adapted to readily engage the collar, as understood by those skilled in the art. The second tube 26 may be aligned with the first tube 25 so that a threaded connector may pass through the first tube and threadably engage the second tube to move the female fitting 23 between the opened position and the closed position. The first tube 25 may have a threaded inner surface and the second tube 26 may have a threaded inner surface. The second tube 26 may be aligned with the first tube 25 so that a threaded connector may pass through and threadably engage the first tube and the second tube to move the female fitting 23 between the opened position and the closed position. The threaded connector advantageously provides enhanced support to the vehicle anchored accessory holder 10 according to the present invention by keeping either the accessory being held by the female fitting 23 or the extension arm stem 41 being held by the female fitting in place.

The open top of the female fitting 23 may have a tab 29 attached to an upper surface portion thereof. The extension arm stem 41 may have a flange 42 substantially encircling the extension arm stem adjacent a medial portion thereof. The flange 42 may have a groove 49 formed therein to accept the tab 29. The tab 29 is adapted to engage the groove 49 in the flange 42. Accordingly, the groove 49 in the flange 42 may act as a guide so that the extension arm 43 may be rotated about a predetermined radius. More specifically, the tab 29 of the female fitting 23 may readily move with respect to the groove 49 so that the range of motion of the extension arm 43 is defined by the length of the groove. The extension arm stem 41 may have an extension arm 43 connected thereto that may extend from the extension arm stem at a predetermined angle and connect at a distal end thereof to an extension arm female fitting 48. The extension arm female fitting 48 may be connected to the extension arm 43. The extension arm female fitting 48 may have an open top to receive, for example, a second extension arm stem 41 or the accessory to be held therein. The extension arm female fitting 48 may have an opening 52 in a first side thereof to receive an extension fitting connector that may be moveable between an engaged position and a disengaged position to secure either the second extension arm stem 41 or the accessory. The open top of the extension arm female fitting may have a tab 47 attached to an upper surface portion thereof. The tab 47 may be adapted to engage a groove 49 formed on a flange 42 substantially encircling the second extension arm stem 41 adjacent a medial portion thereof.

The vehicle anchored accessory holder 10 according to the present invention may further comprise a storage bracket 60 including a storage bracket base 61, and an extension arm cradle 62 attached to and extending outwardly from the storage bracket base. The extension arm cradle 62 may be adapted to surround a portion of the extension arm 43. A connector passageway 64 may be provided adjacent a medial portion of the storage bracket base 61. A shaft collar 63 may surround the connector passageway 64 and may be positioned adjacent the extension arm cradle 62. The shaft collar 63 may extend outwardly from the storage bracket base 61. Accordingly, the storage bracket 60 may advantageously be used to store the components of the vehicle anchored accessory holder 10 when it is in a collapsed position. Placing the vehicle anchored accessory holder 10 in the collapsed position advantageously enhances the ability to readily transport the vehicle anchored accessory holder.

The base plate 28 may include a connector receiving passageway 30 adjacent a medial portion thereof. The connector receiving passageway 30 may have a threaded inner surface. A storage connector may also be provided and may have a threaded exterior surface. The storage connector may be passed through the connector passageway 64 to threadably engage the threaded inner surface of the connector receiving passageway 30. The storage connector may, for example, be a threaded bolt, or any other type of connector that is readily adapted to engage the connector receiving passageway 30, as understood by those skilled in the art.

The vehicle anchored accessory holder 10 according to the present invention may further comprise an adapter including an adapter female fitting 54 having an open top to receive the accessory to be held therein. The width of the open top may be greater than the width of the female fitting 23. The adapter may include an adapter extension arm stem 41 extending downwardly from the adapter female fitting 54 to removeably engage either the female fitting 23 or the extension arm female fitting 48. The adapter female fitting 54 may have an opening 52 in a first side thereof to receive an adapter fitting connector that is moveable between an engaged position and a disengaged position to secure the accessory. The adapter advantageously allows for accessories having various widths to be used in connection with the vehicle anchored accessory holder 10.

The vehicle anchored accessory holder 10 according to the present invention may still further comprise an accessory shaft clamp 70 including a cross member 74, a contact member 72, the contact member connected to and extending outwardly from a first edge 75 of the cross member, a guide member 71 connected to and extending outwardly from a second edge 76 of the cross member, and a guide hole 73 formed through a medial portion of the guide member. The contact member 72 may be adapted to fit against, for example, either an outer surface of the extension arm stem 41 or an outer surface of a portion of the accessory. This advantageously enhances stability of the vehicle anchored accessory holder 10 by providing a secure fit to the extension arm stem 41 or the accessory when held in the female fitting 23 or the extension arm female fitting 48. The guide member 71 may be adapted to permit passage of an accessory connector 170 therethrough. The accessory connector may have a threaded exterior surface and may have a handle 172 on an upper end thereof. The guide member 71 also advantageously enhances stability of the vehicle anchored accessory holder 10 according to the present invention, and the handle 172 may advantageously be used to readily move the accessory connector 170 to an engaged position. The accessory shaft clamp 70 advantageously enhances use of the vehicle anchored accessory holder 10 by providing enhanced security to either the accessory being held by the female fitting 23 or the extension female fitting 48.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed.

That which is claimed is:

1. A vehicle anchored accessory holder comprising:

a base plate;

at least one brace connected to and extending upwardly from the base plate;

a respective at least one angled support connected to the at least one brace;

at least one female fitting connected to and extending upwardly from the base plate, the at least one female fitting also connected to the at least one angled support, wherein the at least one female fitting has an open top to receive at least one of an extension arm stem and an accessory to be held therein, the at least one female fitting having an opening in a first side thereof to receive a fitting connector that is moveable between an engaged position and a disengaged position to secure at least one of the extension arm stem and the accessory;

a first tube and a second tube connected to an upper portion of the at least one female fitting to receive a connector adapted to move the at least one female fitting between an opened position and a closed position, wherein each of the first and second tubes are oriented substantially parallel to an upper surface of the base plate; and a storage bracket including a storage bracket base, at least one extension arm cradle attached to and extending outwardly from the storage bracket base, the at least one extension arm cradle adapted to surround a portion of the extension arm, a connector passageway adjacent a medial portion of the storage bracket base, and a shaft collar surrounding the connector passageway and positioned adjacent the at least one extension arm cradle, the shaft collar extending outwardly from the storage bracket base;

wherein the at least one angled support extends upwardly at a predetermined angle from the base plate to the upper portion of the at least one female fitting.

2. A vehicle anchored accessory holder according to claim 1 wherein the base plate has a substantially pentagonal shape defined by a bottom end and a top end, the bottom end having a polygonal shape and the top end having a triangular shape, wherein the bottom end is connected to the top end to define a monolithic unit.

3. A vehicle anchored accessory holder according to claim 1 or claim 2 wherein the base plate includes a first ridge connected to a first edge of the base plate and a second ridge connected to a second edge of the base plate, the second ridge oriented substantially parallel to the first ridge, wherein the at least one angled support includes a first angled support connected to the base plate adjacent the first edge and a second angled support connected to the base plate adjacent the second edge.

4. A vehicle anchored accessory holder according to claim 1 wherein a collar surrounds the opening in the first side of the at least one female fitting, the collar having a threaded inner surface; wherein the fitting connector has a threaded exterior surface; and wherein the fitting connector threadably engages the collar.

5. A vehicle anchored accessory holder according to claim 1 wherein the second tube has a threaded inner surface and wherein the second tube is aligned with the first tube so that a threaded connector may pass through the first tube and threadably engage the second tube to move the at least one female fitting between the opened position and the closed position.

6. A vehicle anchored accessory holder according to claim 1 wherein the first tube has a threaded inner surface and the second tube has a threaded inner surface and wherein the second tube is aligned with the first tube so that a threaded connector may pass through and threadably engage the first tube and the second tube to move the at least one female fitting between the opened position and the closed position.

7. A vehicle anchored accessory holder according to claim 1 wherein the open top of the at least one female fitting has a tab attached to an upper surface portion thereof and wherein the extension arm stem has a flange substantially encircling the extension arm stem adjacent a medial portion thereof, the flange having a groove formed therein to accept the tab.

8. A vehicle anchored accessory holder according to claim 7 wherein the extension arm stem has an extension arm connected thereto, the extension arm extending from the extension arm stem at a predetermined angle and connected at a distal end thereof to an extension arm female fitting, the extension arm female fitting connected to the extension arm, wherein the extension arm female fitting has an open top to receive at least one of a second extension arm stem and the accessory to be held therein, the extension arm female fitting having an opening in a first side thereof to receive an extension fitting connector that is moveable between an engaged position and a disengaged position to secure at least one of the second extension arm stem and the accessory.

9. A vehicle anchored accessory holder according to claim 8 wherein the open top of the extension arm female fitting has a tab attached to an upper surface portion thereof, the tab adapted to engage a groove formed on a flange substantially encircling the second extension arm stem adjacent a medial portion thereof.

10. A vehicle anchored accessory holder according to claim 1 wherein the base plate includes a connector receiving passageway adjacent a medial portion thereof; wherein the connector receiving passageway has a threaded inner surface; and wherein a storage connector having a threaded exterior surface may pass through the connector passageway to threadably engage the threaded inner surface of the connector receiving passageway.

11. A vehicle anchored accessory holder comprising:

a base plate;

a first brace connected to and extending upwardly from the base plate;

a second brace connected to and extending upwardly from the base plate;

a first angled support connected to the first brace;

a second angled support connected to the second brace;

a female fitting connected to and extending upwardly from the base plate, the female fitting also connected to the first angled support and the second angled support, wherein the female fitting has an open top to receive at least one of an extension arm stem and an accessory to be held therein, the female fitting having an opening in a first side thereof to receive a fitting connector that is moveable between an engaged position and a disengaged position to secure at least one of the extension arm stem and the accessory;

a first tube and a second tube connected to an upper portion of the female fitting to receive a connector adapted to move the female fitting between an opened position and a closed position, wherein each of the first and second tubes are oriented substantially parallel to an upper surface of the base plate; and a storage bracket including a storage bracket base, at least one extension arm cradle attached to and extending outwardly from the storage bracket base, the at least one extension arm cradle adapted to surround a portion of the extension arm, a connector passageway adjacent a medial portion of the storage bracket base, and a shaft collar surrounding the connector passageway and positioned adjacent the at least one extension arm cradle, the shaft collar extending outwardly from the storage bracket base;

wherein the first angled support extends upwardly at a predetermined angle from a point adjacent a first edge of the base plate to the upper portion of the female fitting, wherein the second angled support extends upwardly at a predetermined angle from a point adjacent a second edge of the base plate to the upper portion of the female fitting, wherein the base plate includes a first ridge connected to the first edge of the base plate and a second ridge connected to the second edge of the base plate, the second ridge oriented substantially parallel to the first ridge, wherein the extension arm stem has an extension arm connected thereto, the extension arm extending from the extension arm stem at a predetermined angle and connected at a distal end thereof to an extension arm female fitting, the extension arm female fitting connected to the extension arm, wherein the extension arm female fitting has an open top to receive at least one of a second extension arm stem and the accessory to be held therein, the extension arm female fitting having an opening in a first side thereof to receive an extension connector that is moveable between an engaged position and a disengaged position to secure at least one of the second extension arm stem and the accessory therein.

12. A vehicle anchored accessory holder according to claim 11 wherein the base plate has a substantially pentagonal shape defined by a bottom end and a top end, the bottom end having a polygonal shape and the top end having a triangular shape, wherein the bottom end is connected to the top end to define a monolithic unit.

13. A vehicle anchored accessory holder according to claim 11 wherein a collar surrounds the opening in the first side of the female fitting, the collar having a threaded inner surface; wherein the fitting connector has a threaded exterior surface; and wherein the fitting connector threadably engages the collar.

14. A vehicle anchored accessory holder according to claim 11 wherein the second tube has a threaded inner surface and wherein the second tube is aligned with the first tube so that a threaded connector may pass through the first tube and threadably engage the second tube to move the female fitting between the opened position and the closed position.

15. A vehicle anchored accessory holder according to claim 11 wherein the first tube has a threaded inner surface and the second tube has a threaded inner surface and wherein the second tube is aligned with the first tube so that a threaded connector may pass through and threadably engage the first tube and the second tube to move the female fitting between the opened position and the closed position.

16. A vehicle anchored accessory holder according to claim 11 wherein the open top of the female fitting has a tab attached to an upper surface portion thereof and wherein the extension arm stem has a flange substantially encircling the extension arm stem adjacent the medial portion thereof, the flange having a groove formed therein to accept the tab.

17. A vehicle anchored accessory holder according to claim 16 wherein the open top of the extension arm female fitting has a tab attached to an upper surface portion thereof, the tab adapted to engage a groove formed on a flange substantially encircling the second extension arm stem adjacent a medial portion thereof.

18. A vehicle anchored accessory holder according to claim 11 wherein the base plate includes a connector receiving passageway adjacent a medial portion thereof; wherein the connector receiving passageway has a threaded inner surface; and wherein a storage connector having a threaded exterior surface may pass through the connector passageway to threadably engage the threaded inner surface of the connector receiving passageway.

* * * * *